US006499270B2

(12) United States Patent
Peroni et al.

(10) Patent No.: US 6,499,270 B2
(45) Date of Patent: Dec. 31, 2002

(54) METHOD AND APPARATUS FOR TRANSFERRING OBJECTS

(75) Inventors: Günther Peroni, Bolzano (IT); Giuseppina Martelli, Merano (IT)

(73) Assignee: Pyxis Corporation, San Diego, CA (US)

( * ) Notice: Subject to any disclaimer, the term of this patent is extended or adjusted under 35 U.S.C. 154(b) by 0 days.

(21) Appl. No.: 09/755,631

(22) Filed: Jan. 5, 2001

(65) Prior Publication Data

US 2002/0124535 A1 Sep. 12, 2002

Related U.S. Application Data

(63) Continuation-in-part of application No. 09/031,584, filed on Feb. 27, 1998, now Pat. No. 5,967,730, and a division of application No. 09/087,607, filed on May 29, 1998, now Pat. No. 6,217,273.

(30) Foreign Application Priority Data

Aug. 4, 1997 (IT) ..... BO97A0489
Aug. 4, 1997 (IT) ..... BO97A0490
Oct. 14, 1997 (EP) ..... 97203185

(51) Int. Cl.[7] ..... B65B 57/00; B65G 1/00

(52) U.S. Cl. ..... 53/53; 53/272; 53/276; 53/451; 53/554; 53/555; 198/369.1; 414/331.05

(58) Field of Search ..... 53/53, 551, 552, 53/554, 555, 450, 451, 272, 276; 414/331.05, 331; 198/346.2, 369.1, 370.03; 493/187

(56) References Cited

U.S. PATENT DOCUMENTS 1,497,576 A 6/1924 Molins
1,812,501 A 6/1929 Strobel
1,984,659 A 12/1934 Simmons et al.
2,074,267 A 3/1937 O'Donnell (List continued on next page.)

FOREIGN PATENT DOCUMENTS

| | | | |
|---|---|---|---|
| EP | 0403869 | * | 6/1990 |
| GB | 2076351 | * | 5/1980 |
| GB | 0336714 | * | 4/1989 |
| WO | WO 9521116 | * | 1/1995 |

*Primary Examiner*—Rinaldi I. Rada
*Assistant Examiner*—Christopher Harmon
(74) *Attorney, Agent, or Firm*—Michael D. Steffensmeier

(57) ABSTRACT

The present invention is an automated and integrated method and apparatus for packaging, loading, storing, and/or retrieving a specified product. A preferred embodiment of a system comprises a packager, a feeder device, a magazine, an unloading device, and a control unit. The packager is adapted to package a predetermined quantity of a product in a package. The feeder device has a loading screw which engages the package and transfers it to a storage screw in the magazine. The magazine preferably comprises multiple horizontal rows of storage screws. Each horizontal row of storage screws may be individually rotated about a central axis of the magazine. The control unit maintains a data base of the location and contents of each package in the magazine. The unloading device is adapted to retrieve a desired package from the magazine. The unloading device then transfers the desired package to a predetermined location such as a tote, bin, or patient specific drawer.

18 Claims, 30 Drawing Sheets

U.S. PATENT DOCUMENTS 2,193,211 A 3/1940 Taylor
2,735,096 A 2/1956 Miller
2,752,883 A * 7/1956 Curtis ..... 104/166
2,823,830 A 2/1958 Kreidler
3,051,096 A 4/1960 Walsh et al.
3,178,010 A 4/1963 Van Keuren et al.
3,248,005 A 4/1966 Joschko
3,318,067 A 5/1967 Gräfingholt
3,473,286 A 6/1967 Henry
3,350,840 A 11/1967 Gräfingholt
3,355,064 A 11/1967 Schlaf
3,464,588 A 9/1969 Strike et al.
3,478,870 A 11/1969 Segel
3,572,546 A 3/1971 Schlaf
3,597,894 A 8/1971 Harrison
3,624,792 A * 11/1971 Lipfert ..... 221/129
3,680,736 A 8/1972 Viessmann
3,690,510 A 9/1972 Deaton
3,731,841 A 5/1973 Schlaf
3,750,804 A 8/1973 Lemelson
3,770,148 A 11/1973 Hendren
3,874,146 A 4/1975 Watkins
3,894,381 A 7/1975 Christine et al.
3,920,500 A 11/1975 Brieske
3,942,934 A 3/1976 Momiyama et al.
3,982,623 A 9/1976 DePas et al.
4,012,888 A 3/1977 Nichols
4,068,448 A 1/1978 Modeen
4,109,572 A * 8/1978 Roulleau ..... 198/625
4,180,182 A 12/1979 Fish et al.
4,215,524 A 8/1980 Saylor
4,404,879 A * 9/1983 Frohwerk et al. ..... 53/133.8
4,493,178 A 1/1985 Buckner et al.
4,546,901 A 10/1985 Buttarazzi
4,570,418 A 2/1986 Gino
4,596,107 A * 6/1986 Pfleger, Sr. ..... 53/53
4,599,850 A 7/1986 Kopp
4,601,408 A 7/1986 Billing et al.
4,629,210 A 12/1986 Boussemart et al.
4,638,922 A 1/1987 Stoltz
4,676,362 A * 6/1987 Malzkorn ..... 198/465.1
4,678,390 A 7/1987 Bonneton et al.
4,691,500 A * 9/1987 Danforth et al. ..... 198/467.1
4,711,066 A 12/1987 Fox et al.
4,768,330 A 9/1988 Lane, Jr. et al.
4,777,372 A 10/1988 Guarino
4,787,533 A 11/1988 Haroutel et al.
4,789,295 A 12/1988 Boucher, Jr. et al.
4,790,118 A 12/1988 Chilcoate
4,812,629 A 3/1989 O'Neil et al.
4,896,024 A 1/1990 Morello et al.
4,928,473 A * 5/1990 Nagao et al. ..... 53/53
4,938,337 A * 7/1990 Jowitt et al. ..... 198/478.1
4,977,996 A 12/1990 Duce
4,981,409 A 1/1991 Hirose et al.
4,986,485 A 1/1991 Soubrier et al.
4,993,539 A 2/1991 Duce
4,995,531 A 2/1991 Summers
4,996,819 A 3/1991 Davis
5,016,426 A 5/1991 Davis
5,029,430 A 7/1991 Davis
5,125,513 A 6/1992 Branch
5,127,543 A 7/1992 Meisels
5,129,777 A 7/1992 Pohjonen et al.
5,154,275 A * 10/1992 Speckhart et al. ..... 198/465.4
5,155,981 A 10/1992 Tordini
5,183,148 A 2/1993 Kondo
5,207,051 A * 5/1993 Inger et al. ..... 198/465.1
5,235,794 A 8/1993 Center
5,314,243 A 5/1994 McDonald et al.
5,350,051 A * 9/1994 Cooper et al. ..... 198/625
5,351,856 A 10/1994 Laidlaw
5,357,731 A 10/1994 Conway et al.
5,363,987 A 11/1994 Crawford et al.
5,408,807 A 4/1995 Lane, Jr. et al.
5,425,473 A 6/1995 Kvalheim
5,441,158 A * 8/1995 Skinner ..... 198/370.03
5,468,110 A 11/1995 McDonald et al.
5,546,732 A * 8/1996 Coleman et al. ..... 53/450
5,564,803 A 10/1996 McDonald et al.
5,593,267 A 1/1997 McDonald et al.
5,596,867 A 1/1997 Davis
D384,578 S 10/1997 Wangu et al.
5,785,804 A * 7/1998 Kovacs et al. ..... 156/216
5,934,046 A * 8/1999 Whittaker ..... 53/430
5,974,769 A * 11/1999 Vetter ..... 53/450
5,975,279 A * 11/1999 Blattner et al. ..... 198/467.1

* cited by examiner

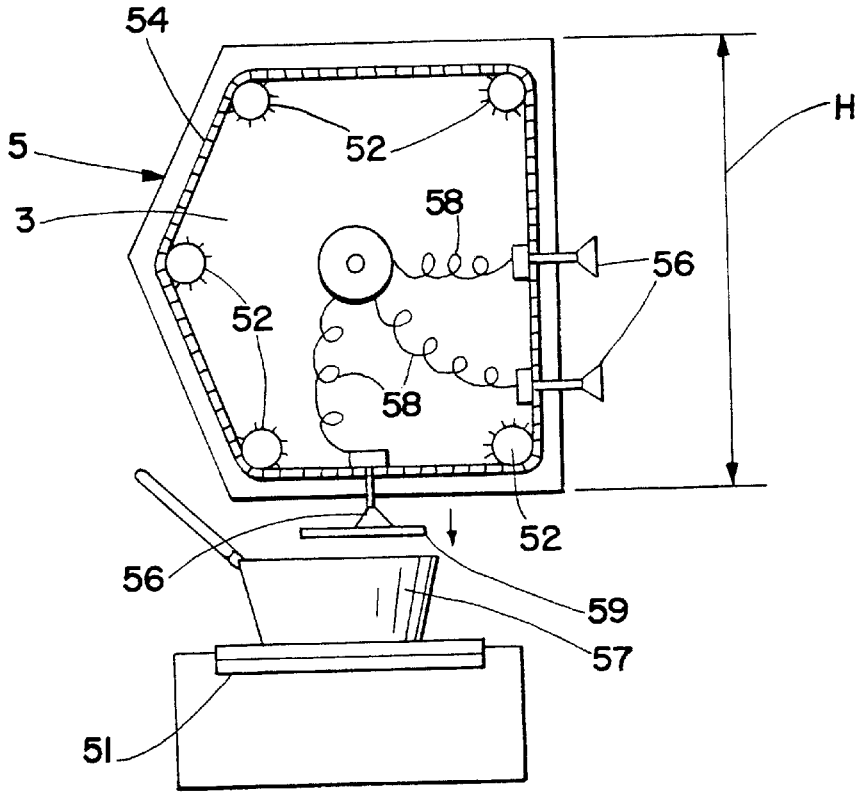
Fig. 14
Fig. 15
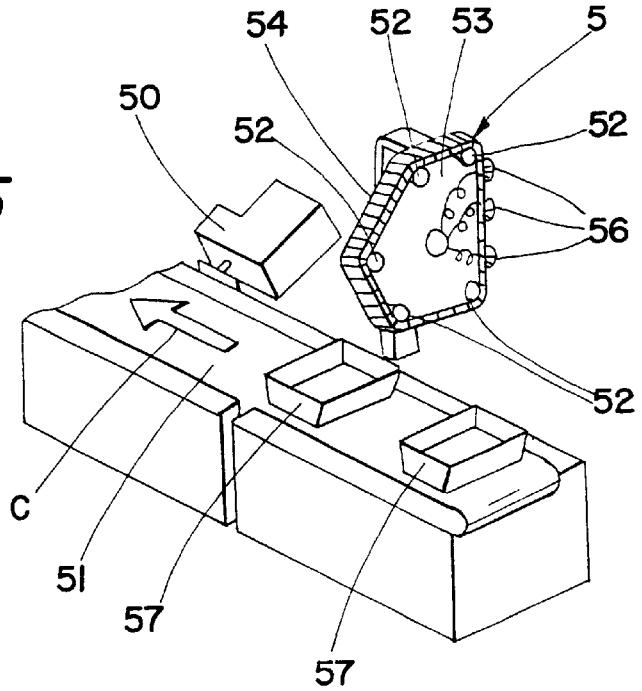

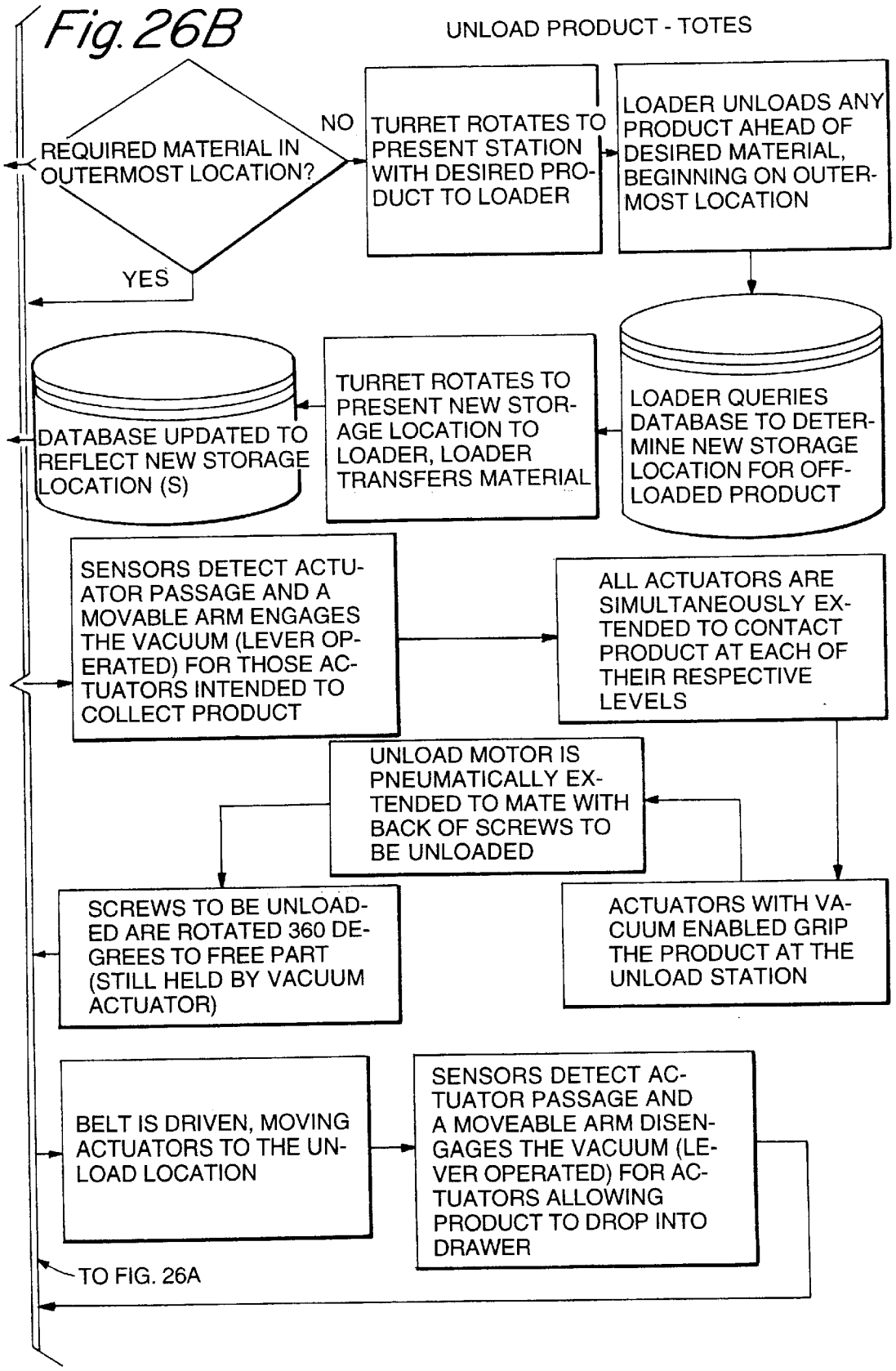
Fig. 26B
UNLOAD PRODUCT - TOTES
REQUIRED MATERIAL IN OUTERMOST LOCATION?
NO
YES
TURRET ROTATES TO PRESENT STATION WITH DESIRED PRODUCT TO LOADER
LOADER UNLOADS ANY PRODUCT AHEAD OF DESIRED MATERIAL, BEGINNING ON OUTERMOST LOCATION
LOADER QUERIES DATABASE TO DETERMINE NEW STORAGE LOCATION FOR OFF-LOADED PRODUCT
TURRET ROTATES TO PRESENT NEW STORAGE LOCATION TO LOADER, LOADER TRANSFERS MATERIAL
DATABASE UPDATED TO REFLECT NEW STORAGE LOCATION (S)
SENSORS DETECT ACTUATOR PASSAGE AND A MOVABLE ARM ENGAGES THE VACUUM (LEVER OPERATED) FOR THOSE ACTUATORS INTENDED TO COLLECT PRODUCT
ALL ACTUATORS ARE SIMULTANEOUSLY EXTENDED TO CONTACT PRODUCT AT EACH OF THEIR RESPECTIVE LEVELS
UNLOAD MOTOR IS PNEUMATICALLY EXTENDED TO MATE WITH BACK OF SCREWS TO BE UNLOADED
SCREWS TO BE UNLOADED ARE ROTATED 360 DEGREES TO FREE PART (STILL HELD BY VACUUM ACTUATOR)
ACTUATORS WITH VACUUM ENABLED GRIP THE PRODUCT AT THE UNLOAD STATION
BELT IS DRIVEN, MOVING ACTUATORS TO THE UNLOAD LOCATION
SENSORS DETECT ACTUATOR PASSAGE AND A MOVEABLE ARM DISENGAGES THE VACUUM (LEVER OPERATED) FOR ACTUATORS ALLOWING PRODUCT TO DROP INTO DRAWER
TO FIG. 26A

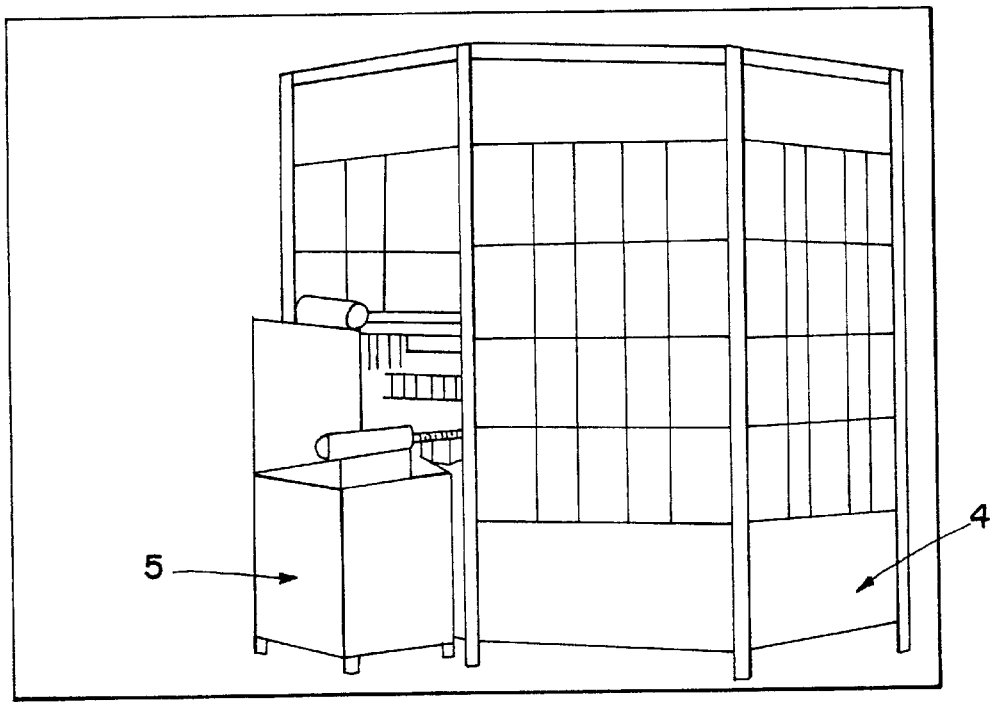
Fig. 32
Fig. 33
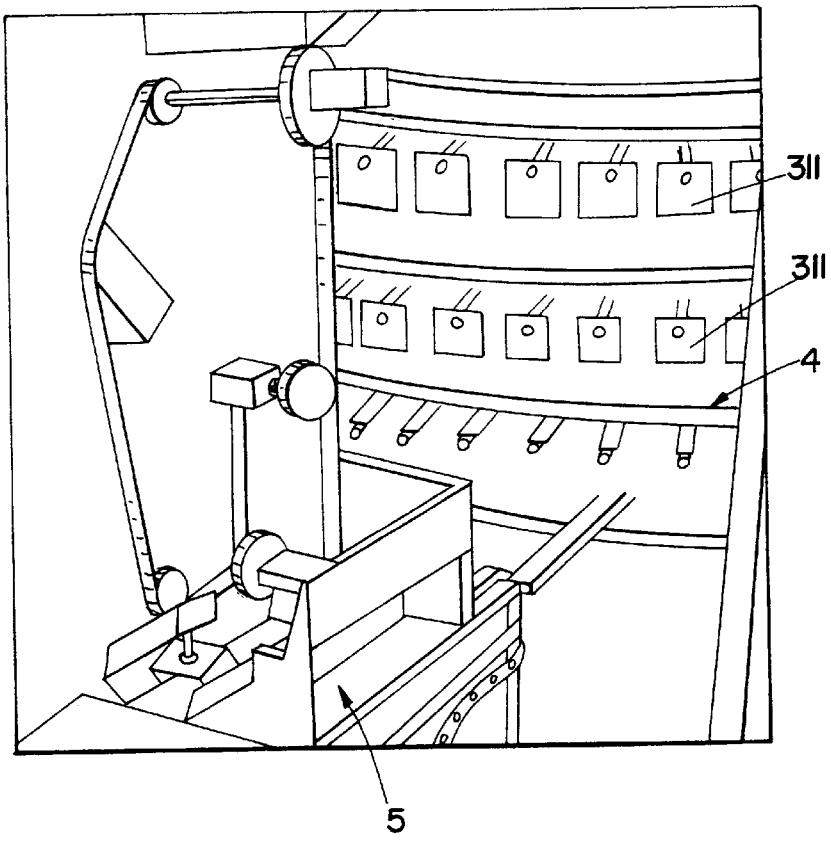

METHOD AND APPARATUS FOR TRANSFERRING OBJECTS

This application is a continuation-in-part of the U.S. application Ser. No. 09/031,584 entitled A DEVICE FOR TRANSFERRING OBJECTS by Gunther Peroni, filed Feb. 27, 1998 now U.S. Pat. No. 5,967,730 and a division of Ser. No. 09/087,607 filed May 29, 1998, now U.S. Pat. No. 6,217,273. In addition, this application claims the benefit under 35 U.S.C. § 119 of the filing dates of the following foreign applications: European Application No. 97203185.0, filed in Europe on Oct. 14, 1997, Italian Application No. BO97A 000489, filed in Italy on Aug. 4, 1997, and Italian Application No. BO97A 000490, filed in Italy on Aug. 4, 1997. The U.S. Application entitled A DEVICE FOR TRANSFERRING OBJECTS by Gunther Peroni, filed Feb. 27, 1998, also claims the benefit under 35 U.S.C. § 119 of the filing date of European Application No. 97203185.0, filed in Europe on Oct. 14, 1997.

BACKGROUND AND SUMMARY OF THE INVENTION

The present invention relates generally to a method and apparatus for transferring products and, more particularly, to an automated and integrated method and apparatus for packaging, loading, storing, and/or retrieving a specified product. A preferred embodiment of the present invention is particularly useful in the field of hospital and pharmacy structures for moving, stocking, and automatically distributing predetermined quantities of medicines of various types in individual packages. However, it should be recognized by persons of ordinary skill in the art that the present invention is useful in other fields for the storage and transfer of any product associated with or having a package.

U.S. Pat. No. 5,593,267 discloses one example of a system for storing and retrieving a product. In particular, U.S. Pat. No. 5,593,267 stores products in a storage rack having a flat grid pattern. Each storage location on the storage rack has distinct X, Y coordinates, and each storage location must only hold packages containing the same type of medicine. A user may utilize a computer to order a specific medication, and the computer commands a mechanical picking arm/device to retrieve a package containing the medication from a specific X, Y coordinate location on the storage rack. This requires a lot of movement by the picking arm/device. Moreover, it consumes time by requiring the picking arm/device to travel a significant distance to the specific X, Y coordinate location on the storage rack.

U.S. Pat. No. 5,593,267 possesses several other shortcomings. Due to the flat grid pattern of the storage rack, the system of U.S. Pat. No. 5,593,267 requires a relatively large amount of space to store a variety of products. The limitation that each storage location can only hold packages containing the same type of medication also contributes to the large amount of space required by the system of U.S. Pat. No. 5,593,267. In addition, several features limit the speed and efficiency of the system of U.S. Pat. No. 5,593,267. In particular, the system of U.S. Pat. No. 5,593,267 cannot simultaneously load the storage rack with packages and retrieve packages from the storage rack. Moreover, the storage rods and the storage rack are immobile. As a result, the system of U.S. Pat. No. 5,593,267 is slow, inefficient, and bulky.

In light of the shortcomings of U.S. Pat. No. 5,593,267, a need exists for an automated storage and retrieval system that requires less space than the system of U.S. Pat. No. 5,593,267. Another need exists for an automated storage and retrieval system which can store different types of products on the same storage screw. Still another need exists for an automated storage and retrieval system that can load the storage device more efficiently than the system of U.S. Pat. No. 5,593,267. Yet another need exists for an automated storage and retrieval system that can retrieve a product from the storage device more efficiently than the system of U.S. Pat. No. 5,593,267. A need also exists for a storage device that has individually rotatable rows of storage locations. In addition, a need exists for an unloading device that may simultaneously unload multiple packages from the storage device. Moreover, another need exists for an automated storage and retrieval system that can simultaneously load and unload the storage device with products.

The present invention provides methods and devices that fulfill and/or facilitate the achievement of some or all of these needs. A preferred embodiment of a system of the present invention may include a packager, a feeder device, a magazine, an unloading device, and a control unit. The packager packages a predetermined quantity of a product in a package. A loading screw of the feeder device engages the package. After the package is engaged, a distal end of the loading screw is coupled to a distal end of a storage screw of the magazine. The package is then transferred from the loading screw to the storage screw by jointly rotating the loading screw and the storage screw in a predetermined direction. The package may be stored on the storage screw of the magazine for a desired time period. The control unit maintains a data base of the location and contents of each package in the magazine. The unloading device is adapted to take the package out of storage. When a user orders the product, the unloading device engages the package with a suction cup. The suction cup removes the package from the storage screw and delivers it to a predetermined release point. At the predetermined release point, the suction cup releases the package and leaves it in a predetermined location such as a tote, container, bin, etc.

In addition to the novel features and advantages mentioned above, other objects and advantage of the present invention will be readily apparent from the following descriptions of the drawings and preferred embodiments.

BRIEF DESCRIPTION OF THE DRAWINGS

FIG. 14 is a side elevational view of a third action sequence of the unloading device shown in FIG. 12;

FIG. 15 is a perspective view of a fourth action sequence of the unloading device shown in FIG. 12;

FIGS. 26A and 26B is a flow diagram of a preferred process of the present invention for unloading products in totes;

FIG. 32 is a pictorial view of another preferred portion of the handling system of the present invention;

FIG. 33 is a pictorial view of another preferred portion of the filling system of the present invention;

DETAILED DESCRIPTION OF PREFERRED EMBODIMENT(S)

The present invention is directed to an automated and integrated method and apparatus for packaging, loading, storing, and/or retrieving a specified product. The present invention will be described primarily with regard to packaging, loading, storing, and retrieving individual packages containing predetermined quantities of medical products. However, it should be recognized that the present invention is useful with other types of products associated with or having other types of supports.

Figure 1:
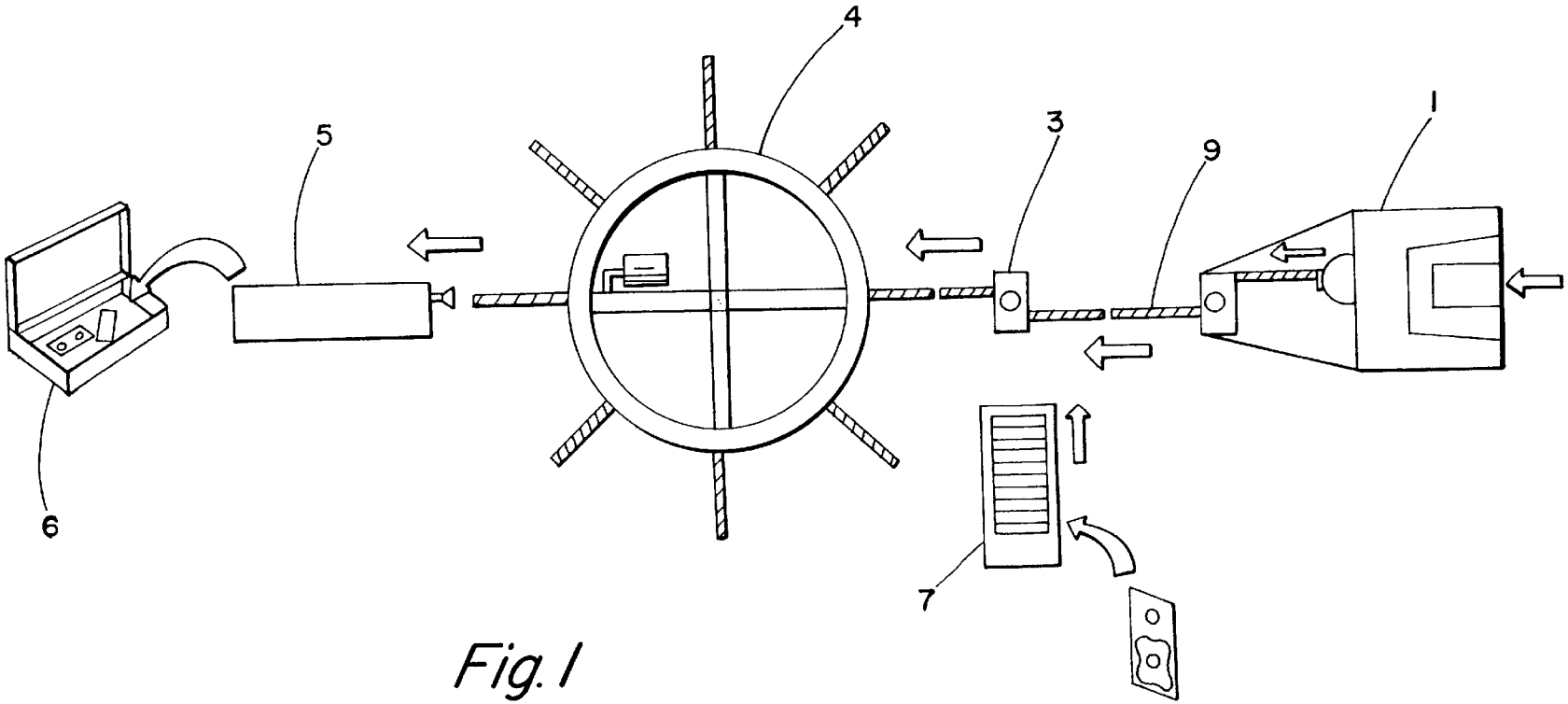
FIG. 1 is a schematic flow diagram of a preferred embodiment of a system of the present invention.

FIG. 1 is a schematic flow diagram of a preferred embodiment of a system of the present invention. A preferred embodiment of a system of the present invention may include a packager 1, a feeder device 3, a magazine 4, an unloading device 5, and a control unit. The packager 1 packages a predetermined quantity of a product in a package. A loading screw of the feeder device 3 engages the package. The loading screw may also engage a package on a loading cart 7. After the package is engaged, a distal end of the loading screw is coupled to a distal end of a storage screw of the magazine 4. The package is then transferred from the loading screw to the storage screw by jointly rotating the loading screw and the storage screw in a predetermined direction. The package may be stored on the storage screw of the magazine 4 for a desired time period. The unloading device 5 is adapted to take the package out of storage. When a user orders the product, the unloading device 5 engages the package with a suction cup. The suction cup removes the package from the storage screw and delivers it to a predetermined release point. At the predetermined release point, the suction cup releases the package and leaves it in a predetermined location 6 such as a tote, container, bin, etc. for later use.

The packager 1 of the present invention packages a predetermined quantity of a product in a support such as a container, a package, a sachet, a tote, or other similar means. As used herein, a package shall mean a support, a container, a sachet, a tote, or any other similar item. The packager 1 is preferably loaded with a specific hopper for the product to be packaged. In one embodiment, the packager 1 is loaded with a medication-specific hopper which is adapted to receive a bulk product such as tablets, caplets, capsules, ampoules, vials, ovules, or ready-to-use syringes. After the hopper is connected to the packager 1, the hopper may be loaded with the product to be packaged. The hopper then preferably distributes a desired quantity of the product to a package. After a desired quantity of the product is placed in the package, the package may be heat-sealed and separated from adjacent packages by conventional means such as a heated die system. In addition, a hole is preferably formed in the package by conventional means to facilitate hanging.

The packager 1 may be loaded with a program which may detail the product to be packaged, the date, a bar code, the expiration date of the product, the lot number, the quantity of the product to be packaged in each package, the package size, and/or the quantity of packages required. In order to facilitate tracking of each package, it is preferred that each package is labeled with a description of the contents, the quantity of the contents, a lot code, an expiration date, a package date, and a bar code. It is preferred that conventional means such as a thermal foil transfer process is used to print the information on the package.

The size of the package may vary according to its contents. The packages are preferably 74 mm wide and either 60, 120, or 180 mm long to accommodate the contents. The packager 1 preferably includes at least one sensor to verify that the proper product is loaded into each package. The packager 1 preferably routs defective packages away from product storage such that the defective packages are discarded.

The packager 1 may transfer all non-defective packages to a predetermined location for engagement by the feeder device. A preferred embodiment of the packager 1 has a transfer screw 9. The packager 1 preferably loads the transfer screw 9 with the non-defective packages for engagement by the feeder device.

Figure 2:
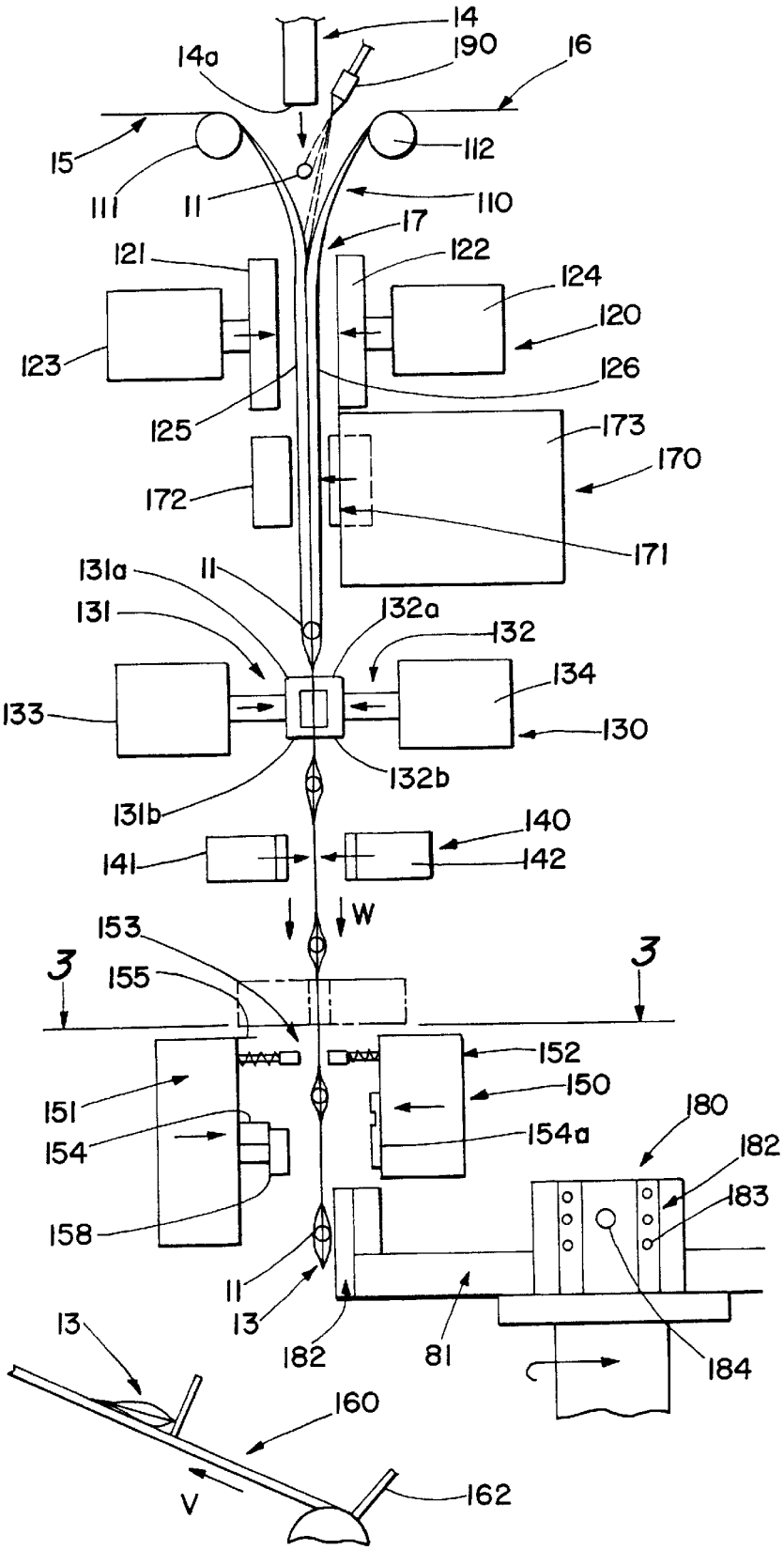
FIG. 2 is a side elevational view of a preferred embodiment of a packager of the present invention.
Figure 3:
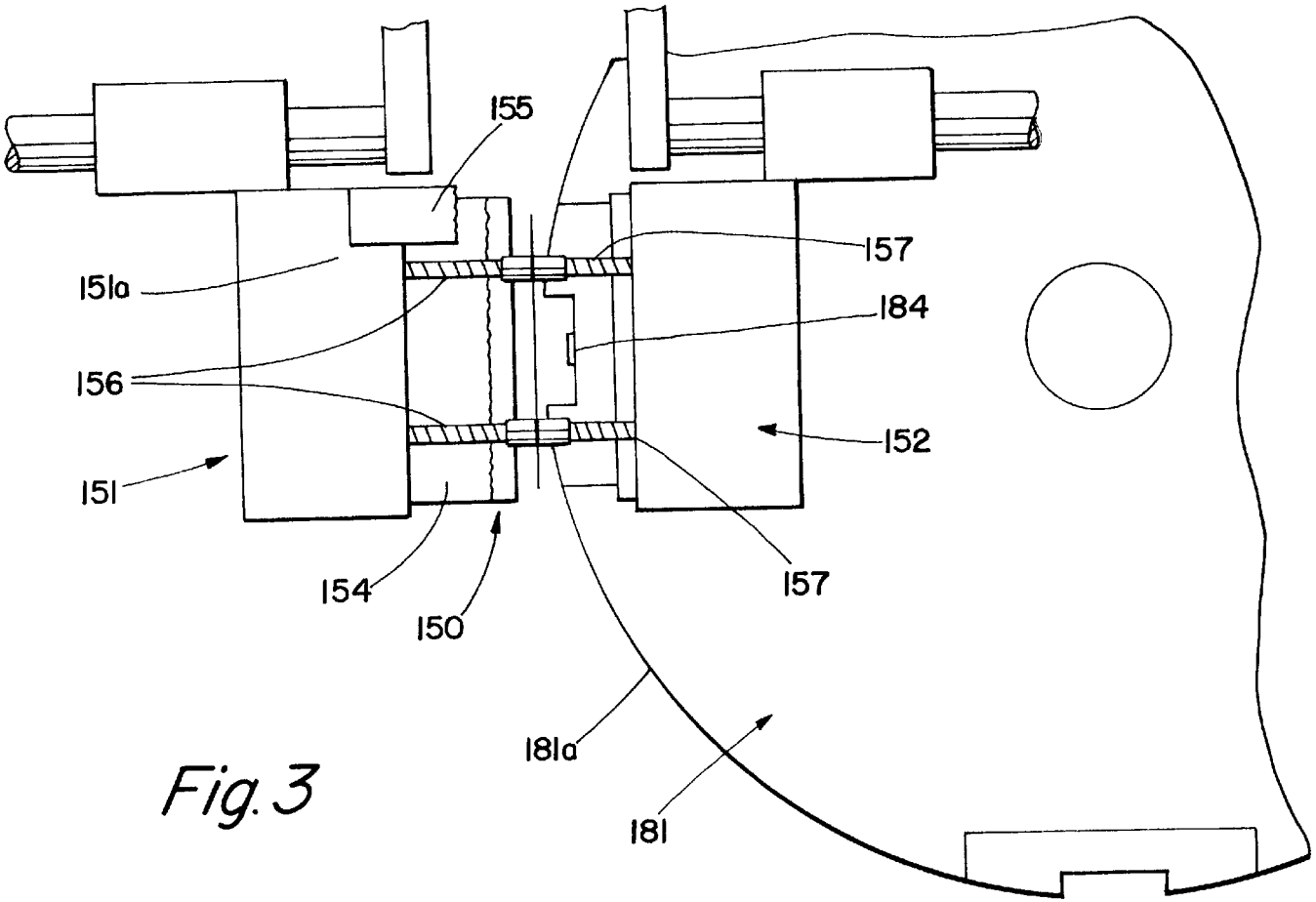
FIG. 3 is a cross-sectional view taken along the line II—II of FIG. 2.
Figure 4:
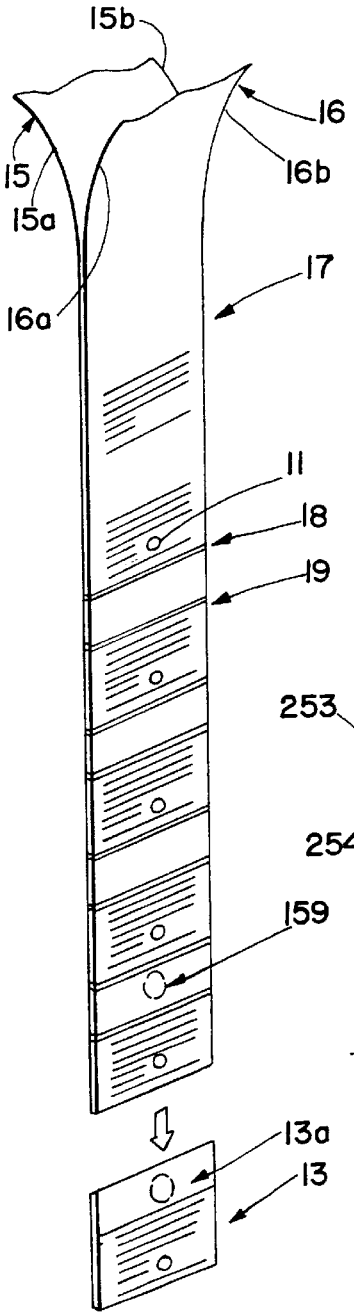
FIG. 4 is a perspective view showing a sequence in the formation of preferred embodiments of packages of the present invention.

An example of a packager 1 will now be described with reference primarily to FIGS. 2 through 4. In this embodiment, products 11 are fed in by a feeder 14. The feeder 14 is designed to release, in predetermined sequences preferably controlled by an electronic computer, the products 11. The packager 1 is situated underneath the feeder 14, and its configuration is substantially vertical. A compressed air emitter 190 may be provided in the vicinity of the feeder 14 for emitting a jet of compressed air toward a tube 17 in order to facilitate the introduction of the falling object 11, released by the feeder 14, into the tube 17.

Located below the feeder 14 are feed members 110 for feeding a pair of continuous strips, a first strip 15 and a second strip 16, made of heat-sealable material. The feed members 110 consist of a pair of horizontal rollers 111, 112 arranged transversely on either side of the strips 15, 16 and running idly on their spindles.

The strips 15, 16 are supplied in a conventional way from opposite directions in a horizontal direction, and pass over the top of their respective rollers 111, 112, by which they are then deflected down, alongside each other and essentially symmetrically about the axis of release of the products 11. The first strip 15 is preferably made of a transparent material while the second strip 16 is preferably made of an opaque material.

Underneath the rollers 111, 112 is a longitudinal sealing station 120 for sealing the outer edges 15*a*, 15*b* of the first strip 15 to the respective outer edges 16*a*, 16*b* of the second strip 16 to define the tube 17 having vertical extension in which said objects 11 can be received. This station comprises a pair of opposing longitudinal sealing jaws, namely a first jaw 121 and a second jaw 122, facing each other symmetrically on the outside of the strips 15, 16 and supported by respective fixed supports 123, 124. The longitudinal sealing jaws 121, 122 are able to move in and out in the supports 123, 124, in phase with each other, to engage and seal portions 125, 126 of the strips 15, 16.

Underneath the longitudinal sealing station 120 is a transverse sealing station 130 for forming transverse sealing lines 18, 19 in the tube 17. The sealing lines define sealed packages 13 suitable for receiving the products 11 one after the other in the tube 17.

The transverse sealing station 130 comprises a pair of opposing transverse sealing jaws, a first jaw 131 and a second jaw 132, facing each other symmetrically on opposite sides of the tube 17 and mounted on respective fixed supports 133, 134. The jaws are able to move in and out in the supports 133, 134 in a horizontal direction and in phase with each other.

Each of the transverse sealing jaws comprises a pair of sealing plates, 131*a*, 131*b* and 132*a*, 132*b* respectively, for producing corresponding pairs of sealing lines, upper 18 and lower 19. The upper transverse sealing line 18 defines the bottom of a package 13 and upper edge of the next package 13, while both sealing lines 18, 19 define a handle zone 13*a* in said package 13.

Interposed between the longitudinal sealing station 120 and transverse sealing station 130 is a printing station 170 for printing specific information about the product 11, or products 11, contained in the package 13, on one side of the tube 17 defined by the second strip 16, at the location of a package 13.

The printing station 170 comprises, more particularly, a print head 171 directed toward the tube 17 and horizontally moveable in a fixed support 173. The print head 171 is intended to come into abutment with a corresponding opposing fixed end stop 172 on the other side of the tube 17.

The print head 171 is preferably of the type having electronically selectable thermal segments, but may equally advantageously be any other known type of print head with programmable characters.

Also below the transverse sealing station 130 are stepper tractor members 140 for pulling the tube 17 down in a direction W. The members 140 comprise a pair of opposing clamps 141, 142 on either side of the tube 17 that are adapted to move in and out in phase with each other and in phase with longitudinal 121, 122 and transverse 131, 132 sealing jaws, in horizontal direction for clamping the tube 17, and then in a vertical direction for pulling it in the direction W.

Below the tractor members 140 is a cutting station 150 for separating the packages 13 from the tube 17. It comprises a pair of opposing supporting heads, a first head 151 and second head 152, arranged on either side of the tube 17 and movable in a horizontal direction toward and away from said tube 17 from opposite sides of the tube 17 and adapted to move in and out in phase with each other and in phase with the longitudinal 121, 122 and transverse 131, 132 sealing jaws; in a horizontal direction for clamping the tube 17, and then in a vertical direction for pulling it in the direction W.

Spring-action gripper members 153 are mounted at the upper end of these supporting heads. They comprise two retractable pistons, namely a first piston 156 and second piston 157, which extend horizontally toward the tube 17. The first pair of pistons 156 are opposed by the second pair of pistons 157 and are designed to arrest the tube 17 temporarily while the supporting heads 151, 152 move toward it.

Extending horizontally from the first supporting head 151, below the spring action gripper members 153, is a first blade 154 for essentially the full width of the tube 17 so as to cut the latter along a transverse sealing line 18 by cooperating with a grooved end stop 154*a* provided in the second supporting head 152.

The first supporting head 151 also comprises, in its top face 151*a*, a second blade 155 extending horizontally in the direction of the tube 17, for a limited part of the width of the tube. It is intended to partially cut the latter on a lower transverse line 19 to make it easier to open.

In the first supporting head 151, underneath the first blade 15, is a punch 154 for producing a hole 159 in the handle zone 13*a* of the pack 13 which is being separated from the tube 17.

In a preferred embodiment, between the cutting station 150 and the conveyor 160 is a station 180 for identifying and eliminating defective packages 13 and presenting non-defective packages to the transfer screw 9. It comprises a horizontal stepper turntable 181 whose outer edge 181*a* is roughly tangential to the package 13 separated from the tube 17. In the vicinity of this outer edge 181 a is plurality of sucker sensors 182 each provided with a plurality of suction holes 183 connected to a vacuum source, and a sensor 184 for sensing the presence of the product 11 in the package 13.

Figure 16A:
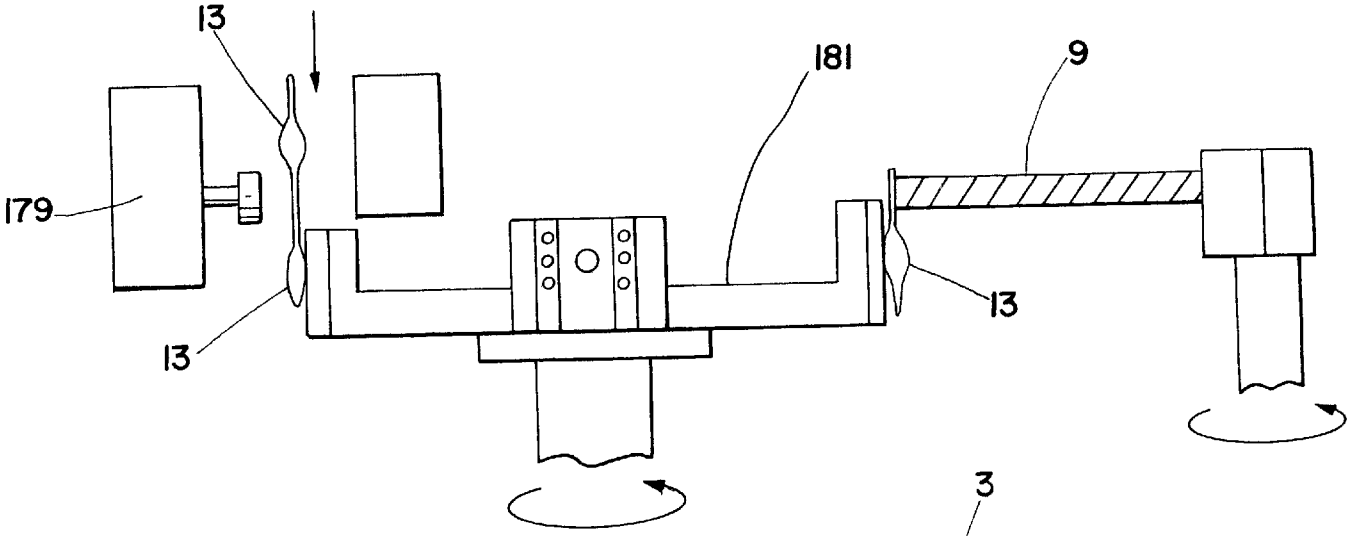
FIGS. 16A and 16B are various views of embodiments of a stepper turntable of the present invention.
Figure 16B:
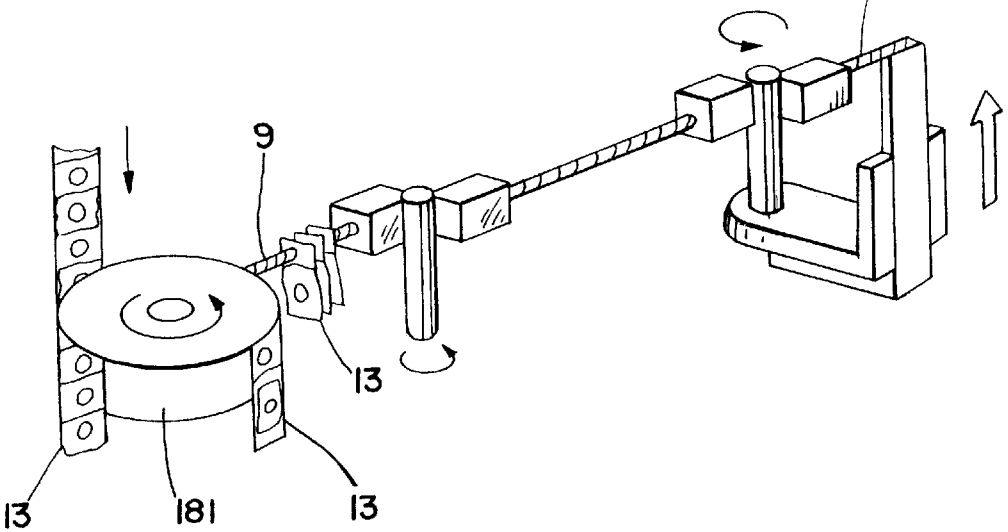

FIGS. 16A and 16B show another preferred embodiment of a stepper turntable 181. In this embodiment, the stepper turntable 181 utilizes air suction to transfer packages 13 to a transfer screw 9. The transfer screw 9 engages a package 13. The transfer screw 9 then rotates to align with a screw of the feeder device 3. A distal end of the transfer screw 9 may be coupled to a distal end of the screw of the feeder device 3. The screws are then jointly rotated to transfer the package 13 to the feeder device 3. The feeder device 3 may then be horizontally rotated to place the feeder device 3 in position to transfer the package 13 to the magazine 4.

Figure 17A:
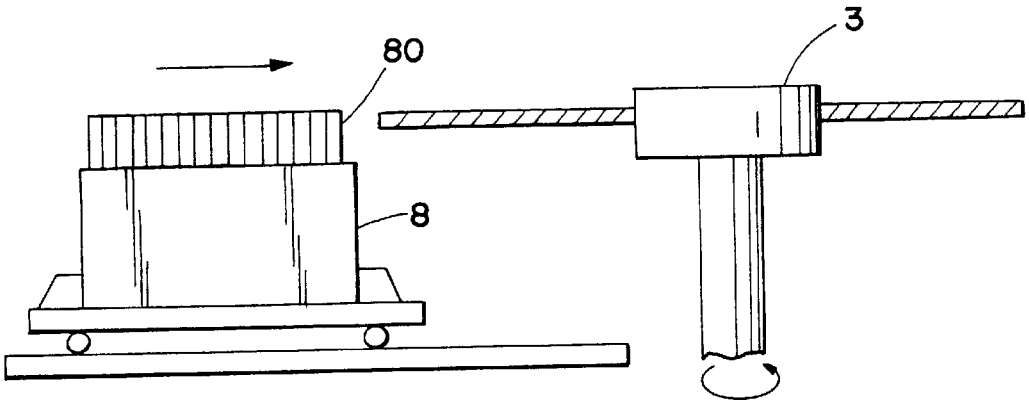
FIGS. 17A–17C are side elevational views of a loading cart adapted to load items via a feeder device of a preferred embodiment of the present invention.
Figure 17B:
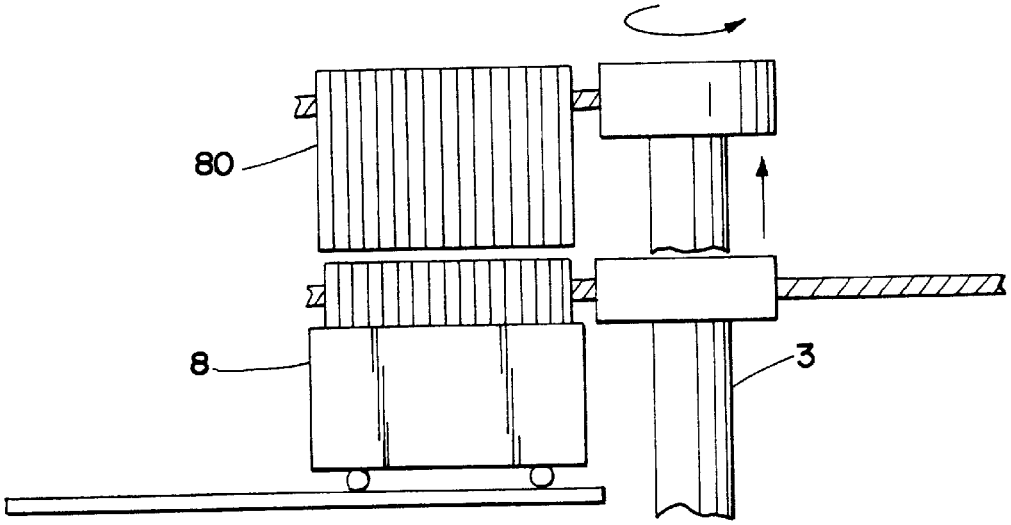
Figure 17C:
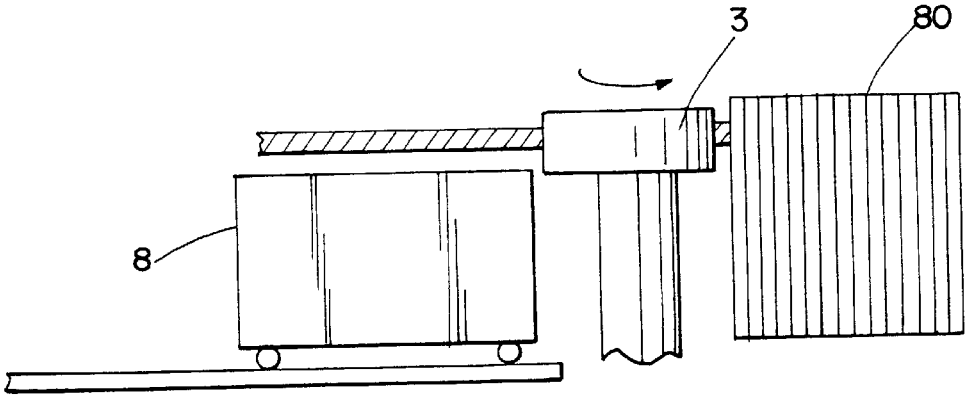

FIGS. 17A–17C are side elevation views of a loading cart 8 adapted to load items 80 via a feeder device 3 of a preferred embodiment of the present invention. A load cart 8 is advanced toward the feeder device 3. The feeder device 3 engages the packages 80 and lifts the packages 80 out of the load cart 8. The feeder device 3 may then rotate horizontally to transfer the packages 80 to the magazine 4.

Figure 18:
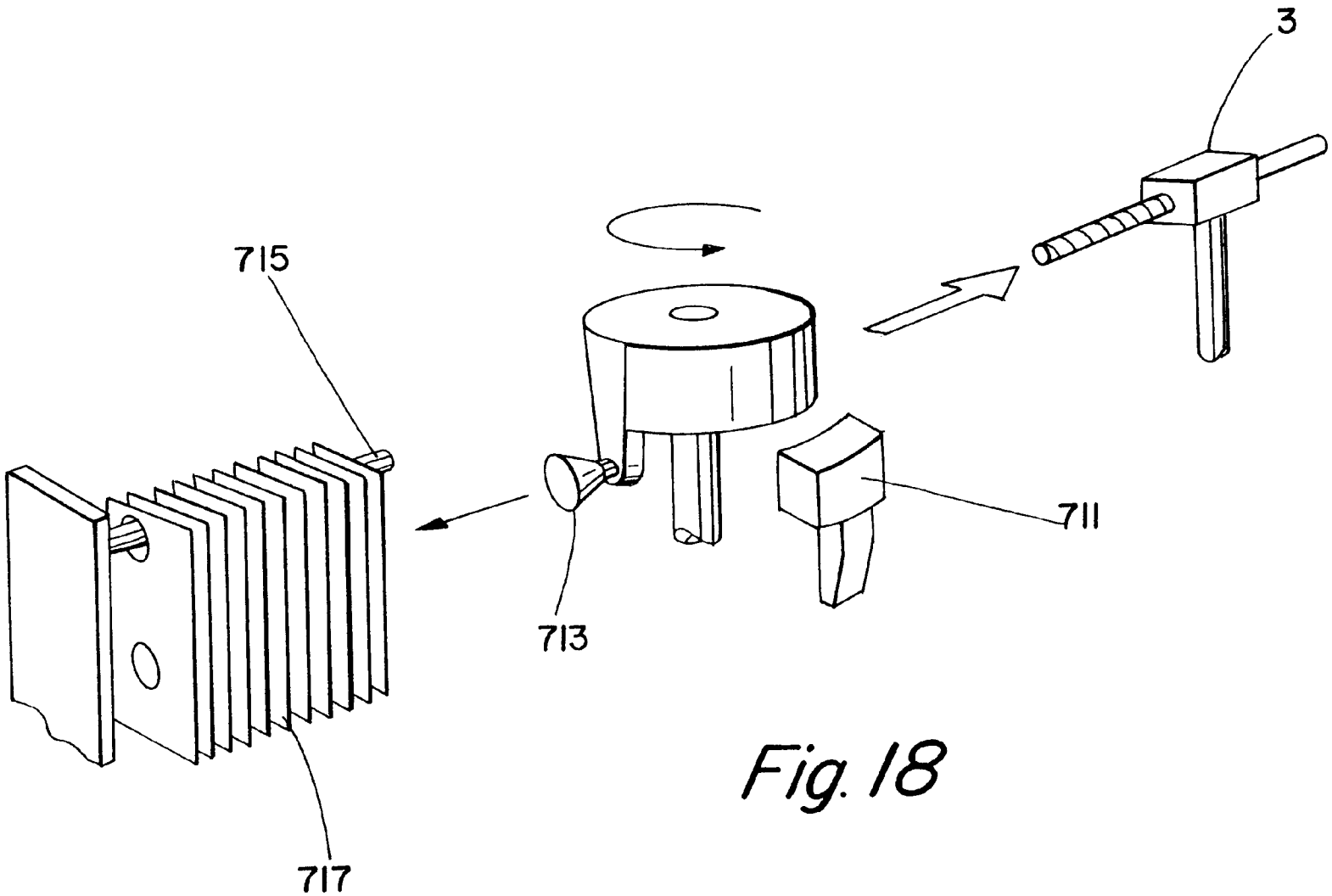
FIG. 18 is a diagrammatical view of an alternative system of loading items via a feeder device.

FIG. 18 is a diagrammatical view of an alternative system of loading items 717 via a feeder device 3. The packages 717 may be manually placed on the rod 715. The suction cup 713 advances toward the rod 715 to engage a package 717. The suction cup 713 advances the package 717 past a bar code or any other similar type of visual/optical identifier 711. The package 717 may then be further rotated to align with the feeder device 3. The feeder device 3 may then engage the package 717.

In another embodiment, beneath the cutting station 150 is a conveyor 160, preferably of the endless belt type, driven stepwise in a direction V away from said station, its function being to receive the packages 13 and convey them to a zone where they will be used. The conveyor may be fitted with transverse plates 162 to facilitate the transport of the packages 13.

A preferred cycle of operation of the packaging machine is described below beginning with a situation in which the first and second strips 15 and 16, respectively, are supported by the rollers 111, 112 and extend downward alongside each other and essentially parallel. The longitudinal sealing jaws 121, 122, the print head 171, the transverse sealing jaws 131, 132, and the clamps 141, 142 are in their respective retracted positions and do not touch the strips 15, 16. The first and second supporting heads 151 and 152, respectively, of the cutting station 150 are also retracted. The turntable 181 is stationary, and one sucker sensor 182 is aligned with the strips 15, 16.

The packager 1 is operated in consecutive working cycles by wholly familiar methods, by a central programmable control circuit, in phase with the operation of the feeder 14. A working cycle for producing a package 13 comprises advancing the longitudinal sealing jaws 121, 122, which seal the portion 126 of the strips 15, 16 to create a section of the tube 17. In the course of previous working cycles, other sections of tube 17 may be made, so the latter is continuous at least as far as the transverse sealing station 130. The clamps 141, 142 are then actuated, initially horizontally, so as to engage the tube 17, and then vertically downward, with a predetermined stroke, in order to pull this tube 17 the same distance down. The clamps are then moved back to their original rest position.

At this point, the print head 171, which is programmed with the information about the package 13 currently being produced, is activated. It moves into abutment with its end stop 172 and prints, on the side of the tube 17 formed by the second strip 16, the information about the product 11 or products 11 which will be contained in the package 13. This information, in the case of medical or paramedical objects for use in a hospital or similar environment, may related to the type of drug, the patient to which it is to be administered, the times of administration and other similar matters.

The clamps 141, 142 are reactivated, as described above, to pull the tube 17 down through another stroke. The transverse sealing jaws 131, 132 are then activated to produce the upper 18 and lower 19 sealing lines, and so define the bottom of the package 13. The feeder 14 may now be activated to release the product 11 or products 11 intended for the package 13. The product 11 or products 11 fall, under gravity and with the help of the jet of compressed air emitted by the emitter 190, into the tube 17, arriving at the bottom of the package 13 level with the transverse sealing station 130.

The clamps 141, 142 are activated again to pull the tube 17 through another stroke, thus bringing the package 13 into the cutting station 150. The first and second supporting heads 151, 152 of this station are then activated in such a way as to cause the pairs of pistons 156, 157 to arrest the package 13, and then the first blade 154 so to cut the tube 17 completely through and separate a package 13 from the preceding package 13, and second blade 155 so as to produce a partial cut in the tube 17 in the same preceding package 13.

Should the package 13 contain no product 11 or products 11, this is detected by the sucker sensor 182. The package 13 is then held by the vacuum holes 183 and therefore removed. If the product 11 or products 11 are present in the normal way in the package 13, the stepper turntable 181 may be rotated to present the package 13 to the transfer screw 9. The transfer screw 9 may be moved into a hole of the package 13 and rotated along its axis to move the package 13 between steps of the thread. In another embodiment, the package 13. falls onto the conveyor 160 which is activated one step to transport this package toward a zone where it will be used.

In the above-described cycle of forming a package 13, the various phases have been listed sequentially. In practice, when the packaging machine is operating normally, these phases take place essentially simultaneously on different packages 13 situated successively along the tube 17. Furthermore, depending on the number and type of product 11 or products 11 to be contained in the package 13, the tractor members 140 may be activated, independently of the activation of the transverse sealing jaws 131, 132, print head 171, and supporting heads 151, 152, for a predetermined number of times in order to produce packages 13 of greater longitudinal dimension. For each actuation of the tractor members 140, there will of course be an actuation of the longitudinal sealing jaws 121, 122 in order to produce corresponding lengths of tube 17.

A preferred embodiment of a hopper 2 for a packager 1 will now be described with reference primarily to FIGS. 5 through 9. The hopper 2 comprises a frame 21 pivotably mounted, in a central position, on a fixed structure 22 forming part, for example, of a packaging machine. The structure 22 has, associated with it, actuator members 23 comprised, for example, of a pneumatic jack and designed to cause oscillation, in a vertical plane, of the frame 21 between two end positions A and B respectively inclined on opposite sides with respect to horizontal. The frame 21 has, removably attached to it, a box-like element 25 which forms, in its upper internal part, a container 26 into which round-shaped articles 27 such as, for example, tablets, capsules, dragees, etc. may be introduced in the loose state.

A selection grid 28 is located at the bottom of the container 26, said grid having calibrated holes **28*a* each allowing one of said articles 27 to pass through with a predetermined orientation. The holes 28*a* communicate with an underlying channel 29, extending horizontally and having a cross-section suitable for containing the articles 27**, in accordance with the orientation determined by the holes

28*a*, and for allowing the same articles 27 to travel in the direction of longitudinal extension of said channel 29.

The channel 29 is closed at one end, while the other end is open opposite an underlying distribution disk 210 carried by the box-like element 25 with a horizontal axis arranged perpendicularly with respect to the plane of oscillation of the frame 21. The distribution disk 210 has a niche 210*a* formed tangentially in its circumference, said niche being designed to contain an article 27. The distribution disk 210 is operated, with an alternating rotary movement, by means denoted in their entirety by 250 and activated in suitable phase relationship with oscillation of the frame 21, as specified more clearly below.

In the end-of-travel positions of the distribution disk 210, the niche 210*a* is situated respectively in a pick-up position P, opposite the outlet of the channel 29, and in a position S for performing unloading toward underlying receiving members 260 provided in the fixed structure 22. The frame 21, in the zone located underneath the distribution disk 210, is suitably provided with an opening 21*a* for allowing the articles 27 to pass through.

Figure 9:
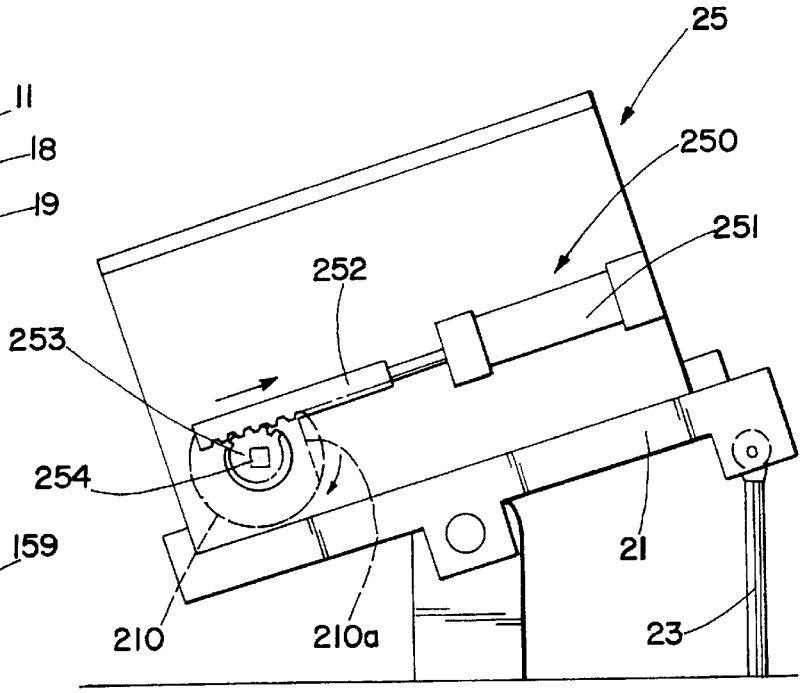
FIG. 9 is a cross-sectional view of a preferred embodiment of the hopper of the present invention.
Figure 5:
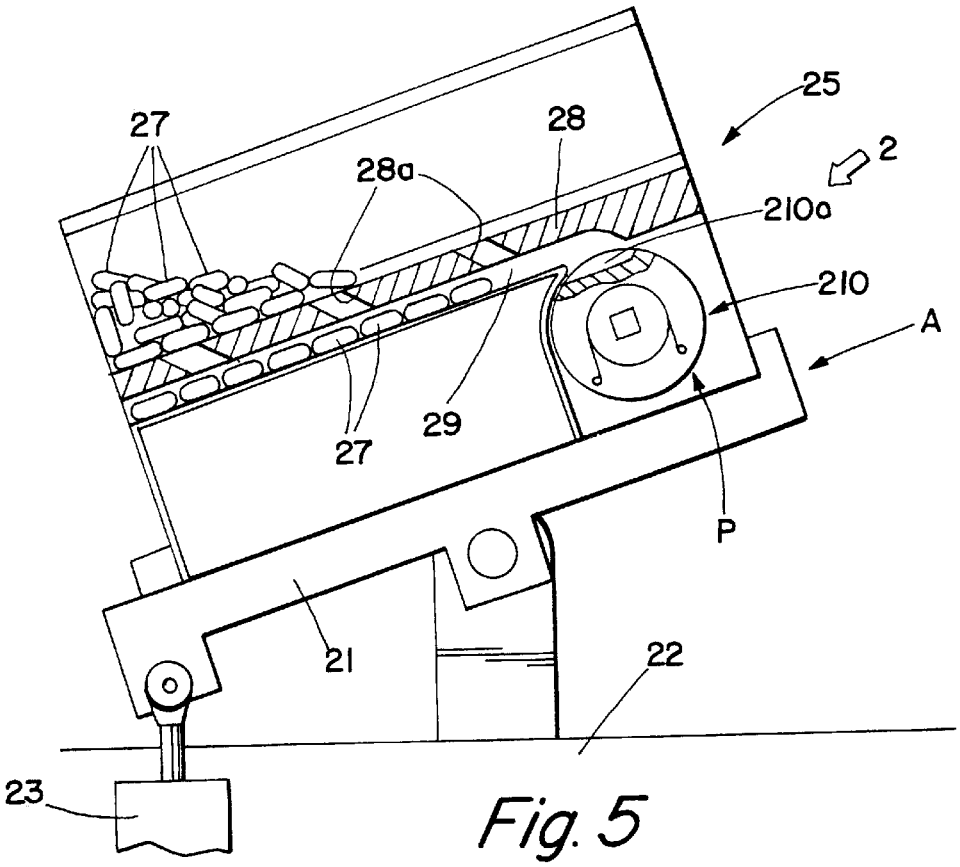
FIG. 5 is a cross-sectional view of a first action sequence of a preferred embodiment of a hopper of the present invention.
Figure 6:
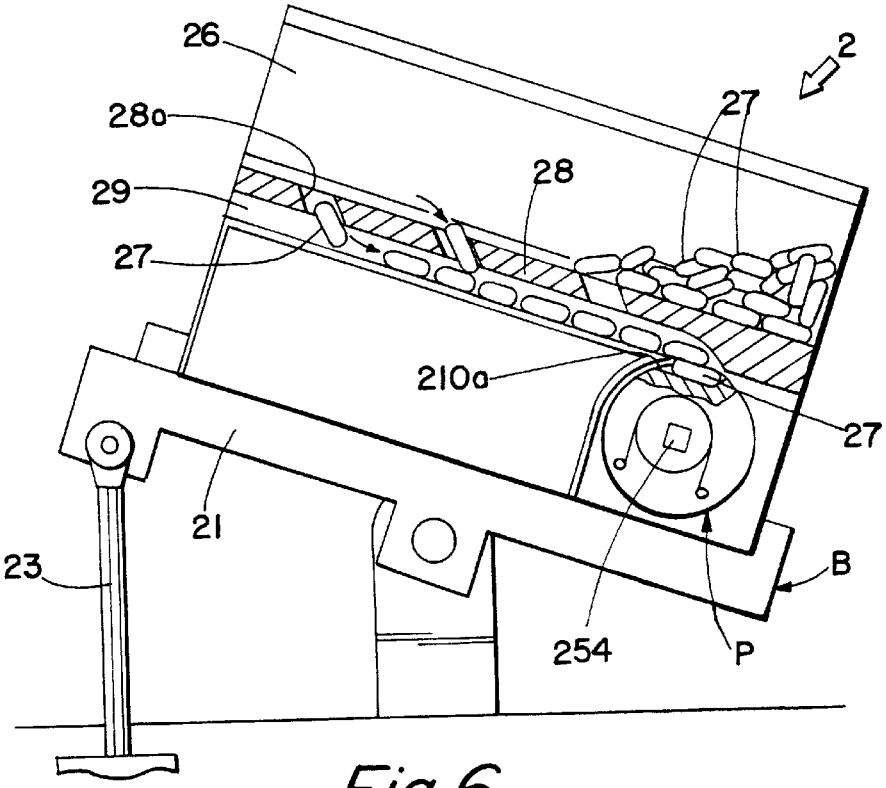
FIG. 6 is a cross-sectional view of a second action sequence of the hopper shown in FIG. 5.
Figure 7:
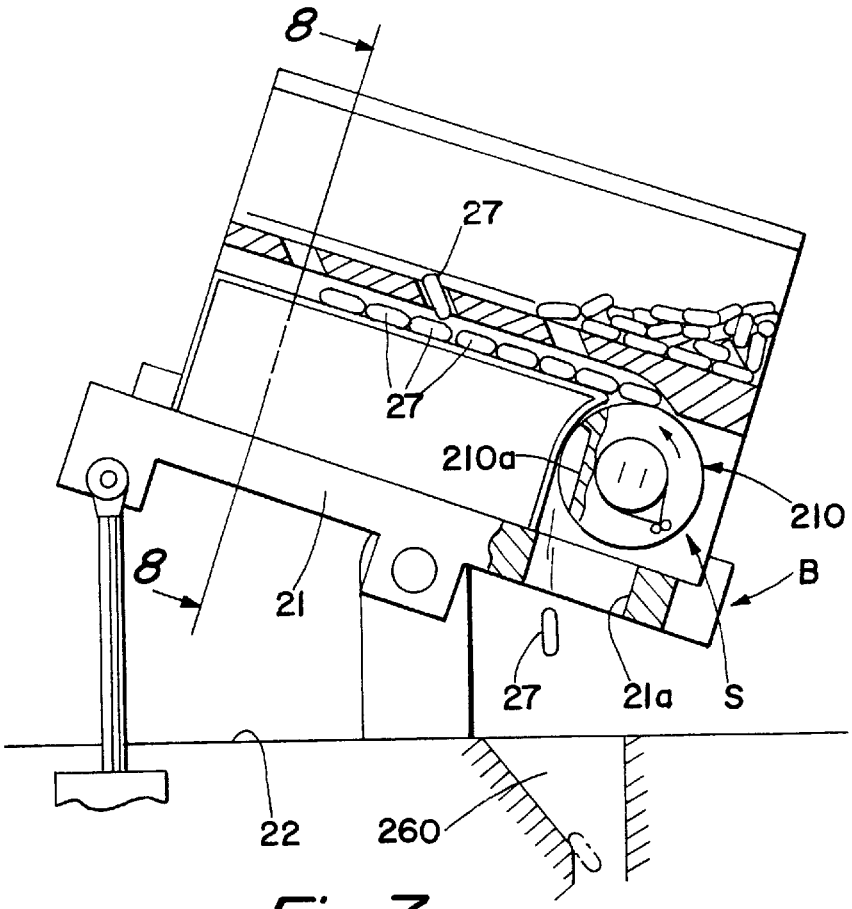
FIG. 7 is a cross-sectional view of a third action sequence of the hopper shown in FIG. 5.
Figure 8:
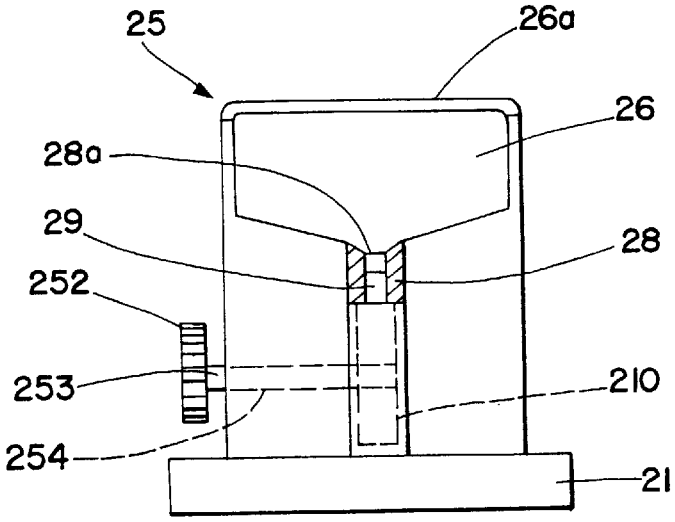
FIG. 8 is a cross-sectional view taken along the line IV—IV of FIG. 7.

The means 250 comprise, in the example illustrated in FIG. 9, a pneumatic jack 251 mounted outside the box-like structure 25 and intended to actuate a rack 252 meshing with a toothed wheel 253 in turn keyed onto a shaft 254 on which said distribution disk 210 is also keyed.

Operation of the hopper 2, described herein below, is governed by the packager 1 on which it has been installed. After loading the articles 27 into the container 26 and if necessary closing the latter with a lid 26*a*, oscillation of the assembly consisting of frame 21 and box-like element 25 starts, said oscillation occurring alternately between the positions A and B. This causes movement of the articles 27 inside the container 26, which facilitates entry, into the holes 28*a*, of the articles 27 which are located lower down, on the selection grid 28. A row of articles 27 therefore gradually forms inside the channel 29 and, with the frame 21 in position B, moves as a result of gravity toward the outlet of the channel 29, where the distribution disk 210 is situated. The latter is located with the niche 210*a* in the aforementioned pick-up position P and therefore the first article 27 in the row is induced to fall into the niche 210*a*.

With the frame 21 still in position B, the means 250 which cause rotation of the distribution disk 210 are then activated, bringing the latter into the unloading position S in which the article 27 contained in the niche 210*a* falls through the opening 21*a* of the frame 21 and enters into said underlying receiving members 260. During rotation from the position P into the position S and back again, the distribution disk 210 acts as an obturator for the channel 29, retaining the row of articles 27 situated in the latter.

The individual supplying of the articles 27 by the hopper 2 may be obtained at regular time intervals, in the case where only one article 27 is required at a time; in this case the distribution disk returns into the position P and the frame 21 performs at least one complete oscillation from the position B into the position A and vice versa.

In the case where it is required to supply two or more articles 27 to be inserted, for example, in the same package, it is possible, in order to increase the operating speed, to keep the frame 21 at a standstill in the position B and actuate the distribution disk 210 as many times as the number of articles 27 to be removed, shortening the time interval between unloading of one article and the next one. The limitation of this latter procedure lies in the capacity of the channel 29 to accumulate a reserve supply and therefore said channel must have a length suited to requirements.

According to a first variant, the distribution disk 210 may be provided with several niches 210*a* and may be actuated with rotations having angular amplitudes equal to the interval between the niches and always in the same direction, for example by means of a stepper motor in place of the means 250 described.

According to a further variant, a second distribution disk 210 may be provided, being arranged symmetrically with respect to the first one at the remaining end of the channel 29, which is therefore also open; in this way it is possible to supply the articles in both the positions of the frame 21. A simple conveyor underneath the device ensures that the articles are correctly channeled toward the receiving members 260.

In order to adapt the hopper 2 to variations in the shape or size of the articles 27, it is sufficient to replace the selection grid 28 with another grid having suitable dimensions of the holes 28*a* and the channel 29, and the distribution disk 210 with another disk having a suitably shaped niche 210*a*. Separating the box-like element 25 from the frame 21 allows, as an alternative, rapid replacement of the whole assembly with another one already specifically designed for a new shape or size. This structural configuration of the hopper 2 has, moreover, the advantage that it is able to safely handle delicate articles 27 such as tablets, capsules, dragees, etc., without damaging them.

The feeder device 3 may collect at least one package such as a heat-sealed polypropylene package from the packager 1. The feeder device 3 is adapted to load the magazine 4 with at least one package containing a predetermined quantity of a product. In addition, the feeder device 3 is also preferably adapted to remove packages from the magazine 4 so that a desired package may be removed from the magazine 4.

Figure 10:
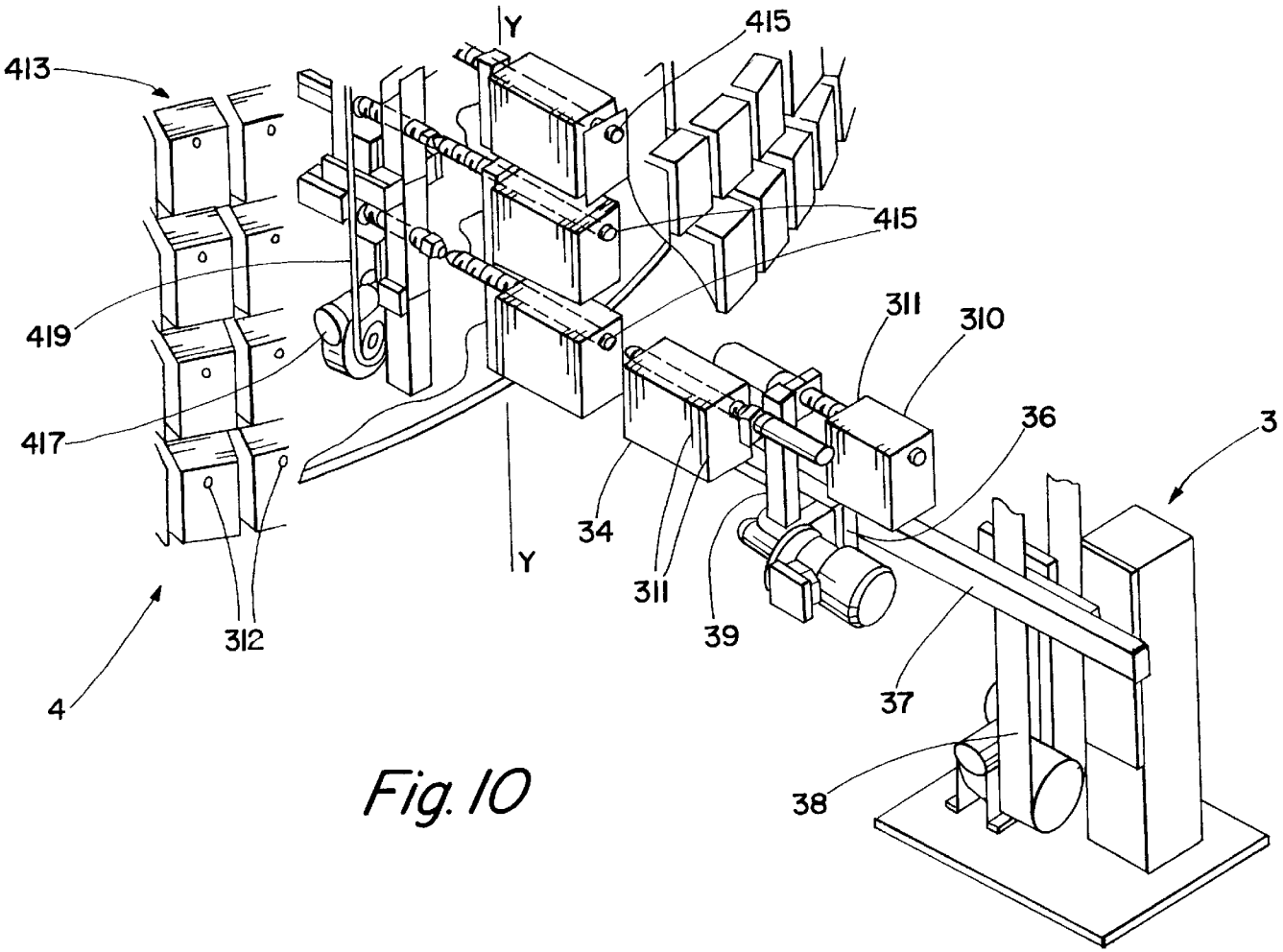
FIG. 10 is a partial perspective view of preferred embodiments of the feeder device and magazine of the present invention.

A preferred embodiment of the feeder device 3 will now be described primarily with reference to FIGS. 10 and 11. This embodiment of the feeder device 3 comprises at least one screw 34 which can rotate on command about a longitudinal axis thereof. The screw is preferably arranged with said axis in a horizontal position. In the specific case, the screw 34 is cylindrical and comprises a cylindrical central core about which is wound a helical relief. The screw 34 is commanded by means of a motor 35 to rotate by predetermined entities. The entity of this rotation is preferably, but not necessarily, a whole multiple of a revolution, for reasons that will become evident herein below. The motor 35 may be comprised, for example, of a step motor.

The screw 34 is mounted on a slide 36 which is slidably coupled on a straight guide 37 having a sliding axis which is parallel to the screw axis. The guide 37 is solidly constrained to a belt 38 with freedom to move vertically in both directions. The screw 34 can perform at least two movements; in a horizontal direction, allowing the screw 34 to near and distance to and from the periphery of the magazine 4, and in a vertical direction, allowing the screw to position itself facing the magazine 4 at a predefined height along the magazine 4.

The screw 34 is mounted on the superior part of a rotatable support shaft 39 having a vertical axis along the line x—x. The support shaft 39 further bears a second screw 310, identical to and arranged symmetrically to the first screw 34, with an axis of symmetry which coincides with the vertical axis along the line x—x of the support shaft 39, so that the two screws 34 and 310 can exchange positions by effect of a 180° rotation of the shaft 39.

The screw 34 (like the other screw 310) can house, appended by two consecutive thread steps, at least one package to which at least one object to be transferred can be associated. In the illustrated case, the package 311 may be able to house at least one object which in the example is represented by a single dose of a medicine, for example a pill or capsule. The package 311 exhibits a hole 312 in which a screw may be inserted so that the package 311 can be appended between two consecutive steps of the screw 34. In the present case the package 311 is a sachet, in which a dose is inserted, which sachet is provided with a through-hole constituting said hole 312.

The package 311 may be freely appended on the screw by said hole 312, so that it is transferable along the axial direction of the screw in both directions by effect of the rotation of the screw. In the example the hole diameter is greater than the diameter of the central core of the screw and smaller than the external diameter of the thread. Each screw 34 and 310 is able to support and advance a plurality of sachet-type packages 311.

Now a preferred embodiment of the magazine 4 will be described, which in the present example comprises a carousel 413, rotatable on command about a vertical axis of rotation along the line y—y. The carousel 413 preferably supports a plurality of screws 415 each having axis which are arranged radially with respect to the axis of the carousel 413. The screws 415 are preferably arranged on various horizontal lines with circumferential extensions, with the lines being located one on another in such a way that the screws 415 are also arranged in columns in a vertical direction.

It is preferred that each horizontal row of screws 415 is a horizontal turret or turntable (a rotatable platform). Each horizontal turntable may be individually rotated. By providing a vertically-oriented magazine 4 and horizontal turntables which may be individually rotated, the amount of floor space consumed by the magazine 4 may be dramatically reduced, and the speeds of the loading and unloading processes may be significantly increased.

A preferred embodiment of the magazine 4 comprises 11 horizontal turntables. Each horizontal turntable preferably includes 72 screws 415. Each screw 415 preferably has 20 separate storage locations between the steps of the thread. As a result, each horizontal turntable preferably has 1440 separate storage locations.

It is preferred that each screw 415 of the magazine 4 is substantially identical to screws 34 and 310 of the feeder device 3. Each screw 415 may be selectively coupled to one or more screws external to the magazine 4. The external screws are in the present example constituted by screws 34 and 310 of the above-described feeder device 3. It is, however, possible to predispose further screws externally to the magazine 4, such screws preferably being situated in proximity of the periphery of the magazine 4. The coupling between the magazine screws 415 and the external screws may be achieved in such a way that it is possible to load and unload predetermined quantities of packages 311 on the magazine 4. In particular, packages 311 may be transferred from the screw 34 to the screw 415 by jointly rotating the screws 34 and 415 in one predetermined direction, and packages may be transferred from the screw 415 back to the screw 34 by jointly rotating the screws 34 and 415 in an opposite direction.

Figure 11:
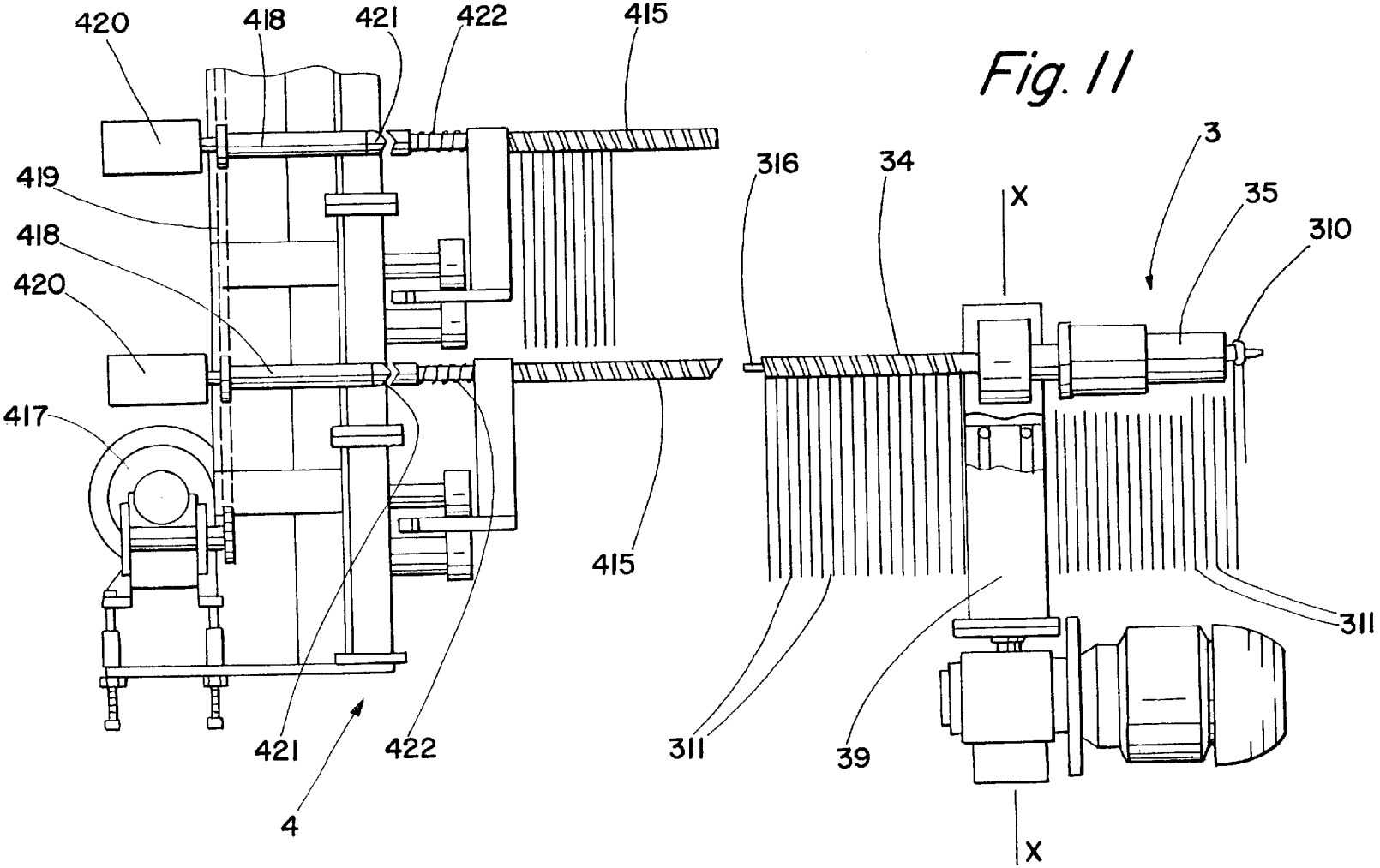
FIG. 11 is a partial side elevational view of the feeder device and magazine shown in FIG. 10.

FIG. 11 shows two screws 415 and 34, one belonging to the magazine 4 and the other to the feeder device 3, having threads angled in the same direction, co-aligned, in a configuration in which a distal end of each thereof is set facing the other. The threads of screws 415 and 34 are reciprocally and freely couplable at said facing ends, so that one screw becomes in effect the continuation of the other and the two screws are reciprocally solid in rotation. In substance, since they may be coupled, the two screws 415 and 34 are adapted to form a single continuous screw. This enables packages 311 to be passed from one screw to the other. Each screw 34 and 310 of the feeder device 3 may selectively assume at least a first position in which it is coupled with a screw 415 of the magazine, and substantially forms therewith a single continuous screw, and a second position (as shown in FIG. 11) in which the two screws 415 and 34 are co-aligned with their respective distal ends at a reciprocal distance. The distal end of one screw 34 of the feeder device 3 exhibits a coaxial projection 316 adapted to be coupled with a recess on the distal end of the other screw 415. The first position may be reached, starting from the position shown in FIG. 11, by moving the screw 34 of the feeder device 3 in the direction toward the screw 415 of the magazine 4 until the projection 316 connects with the recess.

Each screw 415 is preferably adapted to store a plurality of packages 311 between the steps of its thread. It is preferred that only one package 311 is stored between adjacent steps of the thread. However, as opposed to the storage rods of U.S. Pat. No. 5,593,267, a single screw 415 may store a variety of products. A preferred embodiment of the system preferably maintains and updates a record of at least the location and contents of each package on each screw 415. For example, a preferred embodiment of the system may recognize that the one type of product is stored between the second and third steps of a storage screw 415 and that another type of product is stored between the tenth and eleventh steps of the same storage screw 415.

Each screw 415 may be lined up to one or another of the screws 34 or 310 of the feeder device 3, through a special rotation of the carousel 413 and/or a horizontal turntable and a special vertical displacement of the feeder device 3.

Each screw 415 may be commanded to rotate about its longitudinal axis by the motor 35 actuating a screw in the feeder device 3, when the two screws are engaged head-to-head and reciprocally solid in rotation. Each screw 415 may however be commanded to rotate by its own independent actuating means, which means comprise a plurality of motors 417, one preferably for each column of screws 415, each of which sets a plurality of rotatable shafts 418 in rotation; each shaft 418 is coaxial with a corresponding screw 415 of the column and may be removably coupled on command with the screw 415. The shafts 418 are also arranged in columns and in circumferential rows. Each motor 417 associated with a column of screws 415 may be connected to various rotatable shafts 418 of the columns by means of a flexible organ, such as for example a chain or belt 419, which draws all of the shafts 418 in rotation.

Also provided are means for coupling which selectively couple a screw 415 in rotation with a respective coaxial shaft 418. In the present example, the means for coupling comprise, associated to each shaft 418, an element which is solid in rotation with the shaft and able to slide axially with respect to the shaft itself, which may be commanded by a pusher organ 420 to engage with the screw 415 by an end 421 thereof which faces a corresponding end of the screw 415. To uncouple the shaft 418 from the screw 415 the mobile element of the pusher organ 420 is retreated, a return spring 422 guarantees disengagement.

The carousel 413 is provided with a computerized command and control unit, not illustrated, for commanding the carousel 413 so that it unloads at predetermined points the single doses of the type and number requested. In particular, this unit preferably controls the number of rotations made by the screw which loads or unloads the packages 311, inasmuch as for each revolution of the screw there is an axial advancement of the package 311 which is equal to the screw step. So, at each revolution of the screw a single package 311 may be unloaded; thus, by counting the number of revolutions it is possible to calculate how many packages 311 have been loaded or unloaded. In the present example, the single-dose sachets may be loaded or unloaded at the feeder device 3, or at another loading and unloading station (not illustrated).

A preferred embodiment of the magazine 4 may be used to dispense packages containing single doses of medicines. The magazine 4 may be automatically reloaded using the feeder device 3; the relative position on the carousel 413 is registered in an appropriate memory installed in the control unit. When needed, an operator may request a number and type of product through the control unit, whereupon the unit itself will command the system to perform the operations necessary for unloading the ordered number and type from the magazine 4.

A preferred embodiment of an unloading device 5 will now be described primarily with reference to FIGS. 12 through 15. The unloading device 5 is adapted to unload desired packages from the screws 415 of the magazine 4. The unloading device 5 then releases the desired packages in a predetermined location such as a tote or bin. A bar code label with relevant information about the contents of the package may be placed thereon.

Figure 12:
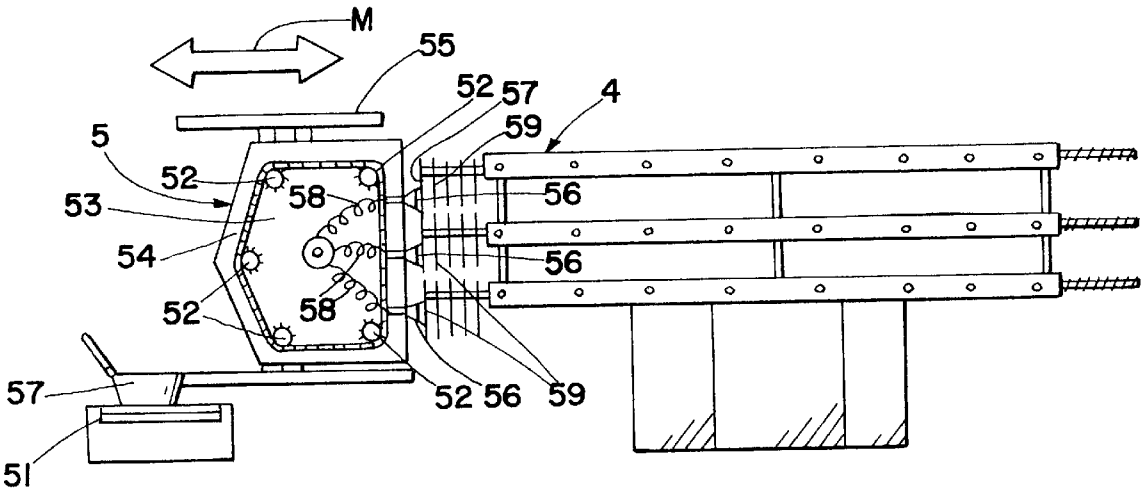
FIG. 12 is a side elevational view of a first action sequence of a preferred embodiment of an unloading device of the present invention.

A preferred embodiment of an unloading device 5 comprises a motor, a plurality of gears 52, a chain 54, and at least one suction cup 56. Each of the gears 52 are adapted to rotate in a predetermined direction in response to a command from said motor. A chain 54 extends around the plurality of gears 52. The chain 54 is adapted to rotate around the plurality of gears 52 in response to rotation of the plurality of gears 52. At least one suction cup 56 is connected to the chain 54. As shown in FIG. 12, the unloading device 5 is adapted to rotate at least one suction cup 56 to a predetermined position near a package 59. The at least one suction cup 56 is adapted to engage the package 59 when the package 59 is placed in contact with the at least one suction cup 56.

To maximize retrieval efficiency, the chain 54 preferably extends around the plurality of gears 52 in a substantially vertical plane with a plurality of suction cups 56 positioned along the chain. By rotating the chain 54 around the plurality of gears 52 in a substantially vertical plane, the unloading device 5 may remove packages 59 from multiple rows of the magazine 4 simultaneously. It should, however, be recognized that the chain 54 may extend around the plurality of gears 52 in any plane.

Figure 13:
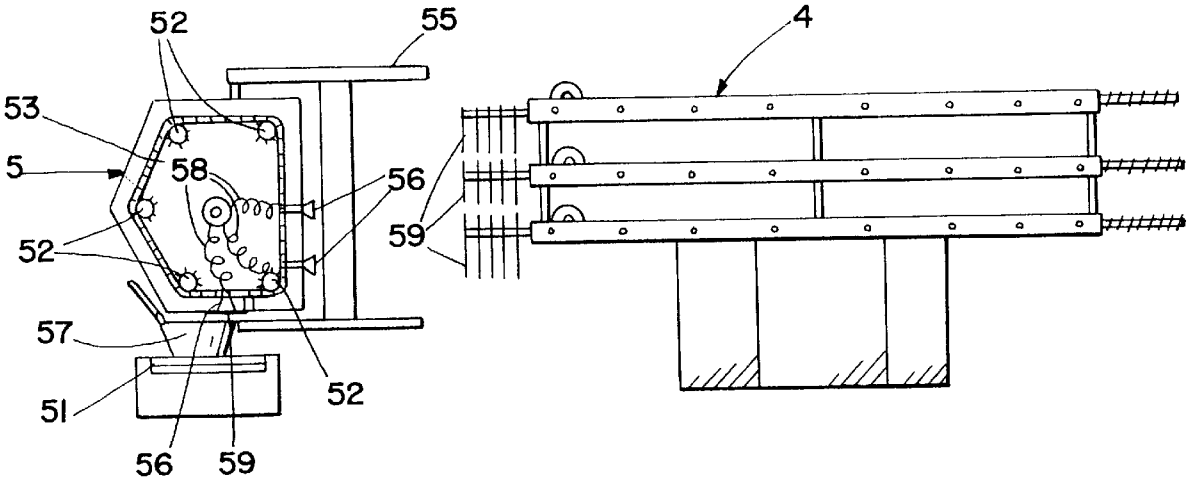
FIG. 13 is a side elevational view of a second action sequence of the unloading device shown in FIG. 12.

FIGS. 12 and 13 show a preferred system for unloading an embodiment of a magazine 4. It is preferred that the unloading device 5 is horizontally movable in the direction indicated by arrow M between the magazine 4 and a predetermined position where it may unload a package 59. In order to accomplish this movement, the plurality of gears 52 may be rotatably connected to a base 53, and the base 53 may be slidably connected to a guide 55.

A preferred process for retrieving a specified product from the magazine 4 will now be described. The control unit maintains a data base which relates storage location to stored contents data. The stored contents data may include content description, quantity, lot number, expirations, bar code, and/or package date. A user may order a specified quantity of a product through the control unit. The control unit locates the package or packages containing the appropriate contents. If there is more than one package containing the appropriate contents, the control unit will determine which package is the easiest to retrieve. The control unit may also be programmed to unload packages that contain products that are soon to expire.

If the desired package is in the outermost, unloading location on the storage screw, the magazine 4 rotates the appropriate turntable so that the storage screw is aligned with the unloading device 5. However, if the package to be retrieved is not on the outermost, unloading location on the storage screw, the magazine rotates the appropriate turntable so that the storage screw is at least aligned vertically with the feeder device 3. If necessary, the screw of the feeder device 3 may be moved up or down in a vertical plane so that it is aligned with the storage screw. The feeder device 3 then removes any packages located between the desired package and the distal end of the storage screw. The desired package is then rotated to the unloading position on the storage screw, and the magazine 4 rotates the appropriate turntable so that the storage screw is aligned with the unloading device 5.

Once the desired package is in the unloading position on the storage screw and aligned with the unloading device 5, the control unit moves the unloading device 5 and rotates the chain 54 such that a suction cup 56 is placed in contact with the desired package. Each suction cup 56 is connected to suction device 58. The control unit activates the suction device 58 that is connected to the suction cup 56 which is in contact with the desired package. As a result, the suction cup 56 engages the desired package.

After the suction cup 56 has engaged the desired package, the control unit causes the appropriate-storage screw to be coupled with its respective coaxial shaft as previously described. The storage screw is then rotated in a predetermined direction to release the desired package to the suction cup 56. With the desired package still engaged by the suction cup 56, the control unit may cause the unloading device 5 to retreat from the magazine 4. The control unit may also cause the unloading device S to rotate the suction cup 56 to a predetermined release point. At the predetermined release point, the appropriate suction device 58 is deactivated, and the desired package is released and left in a predetermined location for later use.

Each suction device 58 may include a deactivation rod or other similar means. As a suction cup 56 is rotated to the predetermined release point, the deactivation rod may hit an impediment which causes the suction to be removed from the suction cup 56. As a result, the desired package may be dropped in the predetermined location for later use.

Throughout the above-described process, the control unit preferably updates the data base which relates storage location to stored contents data. In addition, the control unit preferably commands the feeder device 3 to reload any packages that may have been removed from a storage screw to access a desired package.

The same basic process may be used to simultaneously retrieve packages from various horizontal levels of the magazine 4. The height of the unloading device 5, as indicated by the arrow H in FIG. 14, may be approximately equal to the height of the carousel of the magazine 4. In addition, it is preferred that the unloading device 5 has a number of suction cups 56 equal to the number of horizontal rows of screws on the carousel of the magazine 4. At least two of the suction cups 56 may be spaced a predetermined distance apart such that the at least two suction cups 56 are adapted to substantially simultaneously engage packages on different levels of the carousel. In fact, it is preferred that the suction cups 56 are spaced a predetermined distance apart such that the suction cups 56 may simultaneously engage and/or remove packages from each horizontal row of screws on the carousel of the magazine 4.

Figure 19:
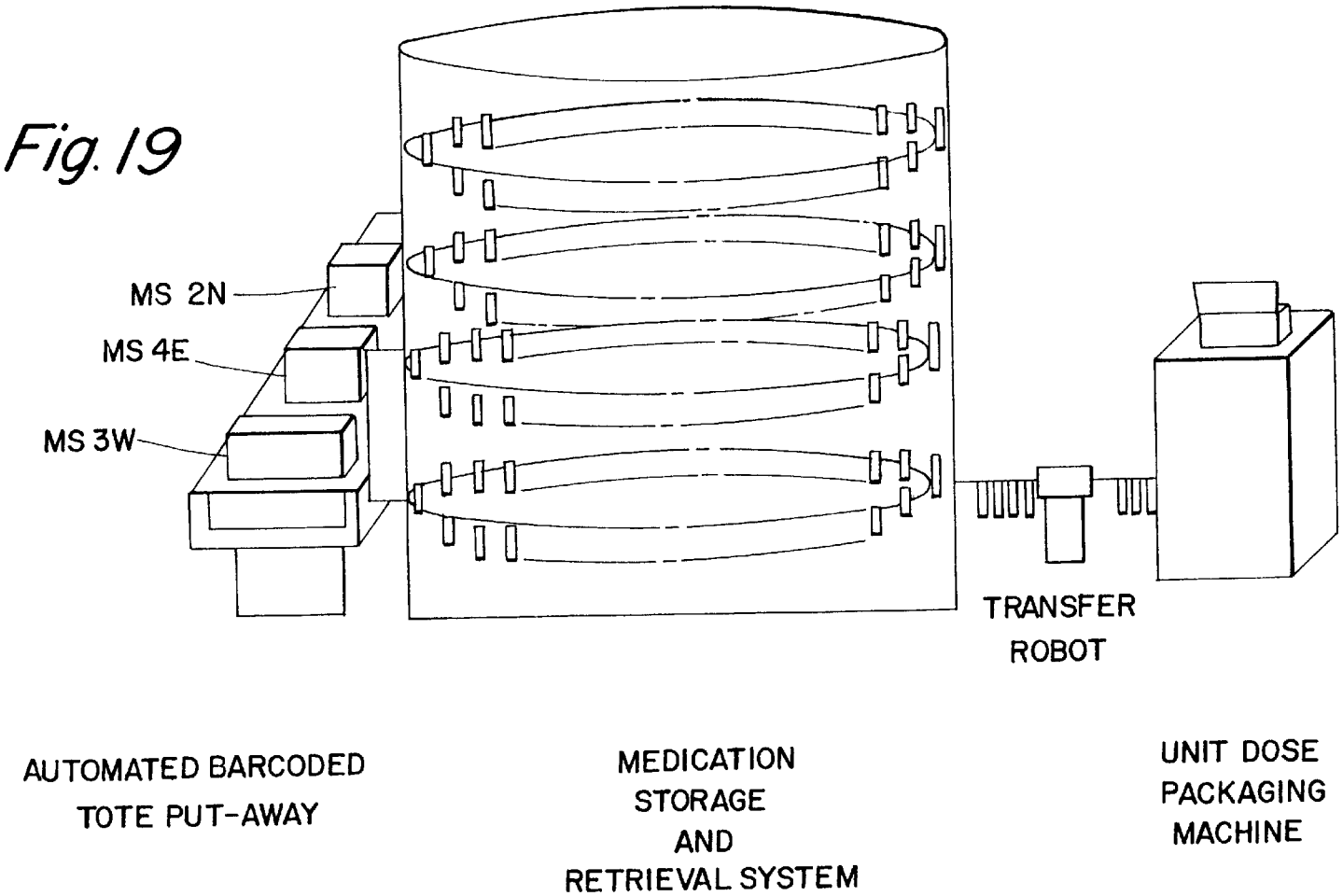
FIG. 19 is a diagrammatical view of one preferred arrangement of the system of the present invention.
Figure 20A:
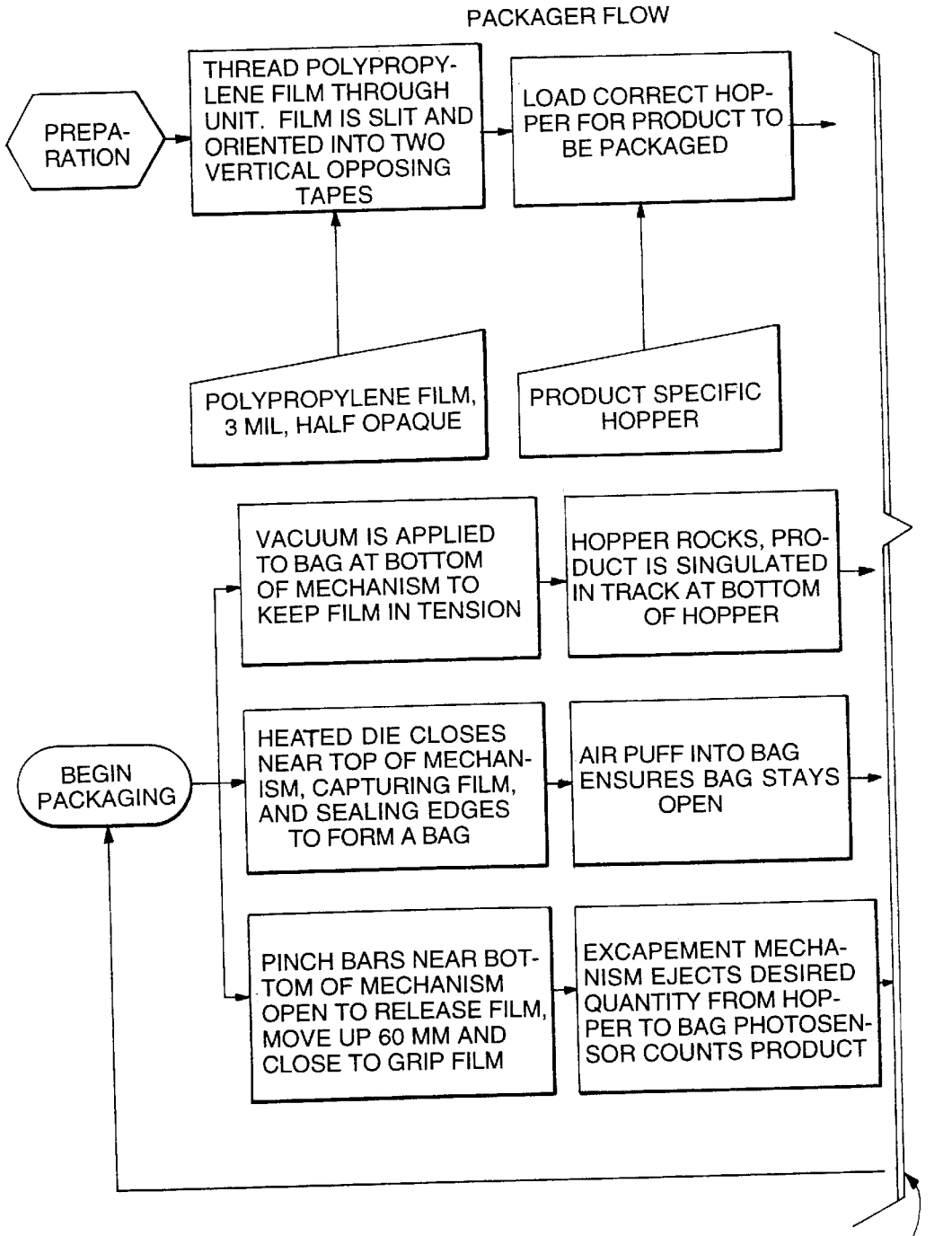
FIGS. 20A and 20B is a flow diagram of a preferred packager process of the present invention.
Figure 20B:
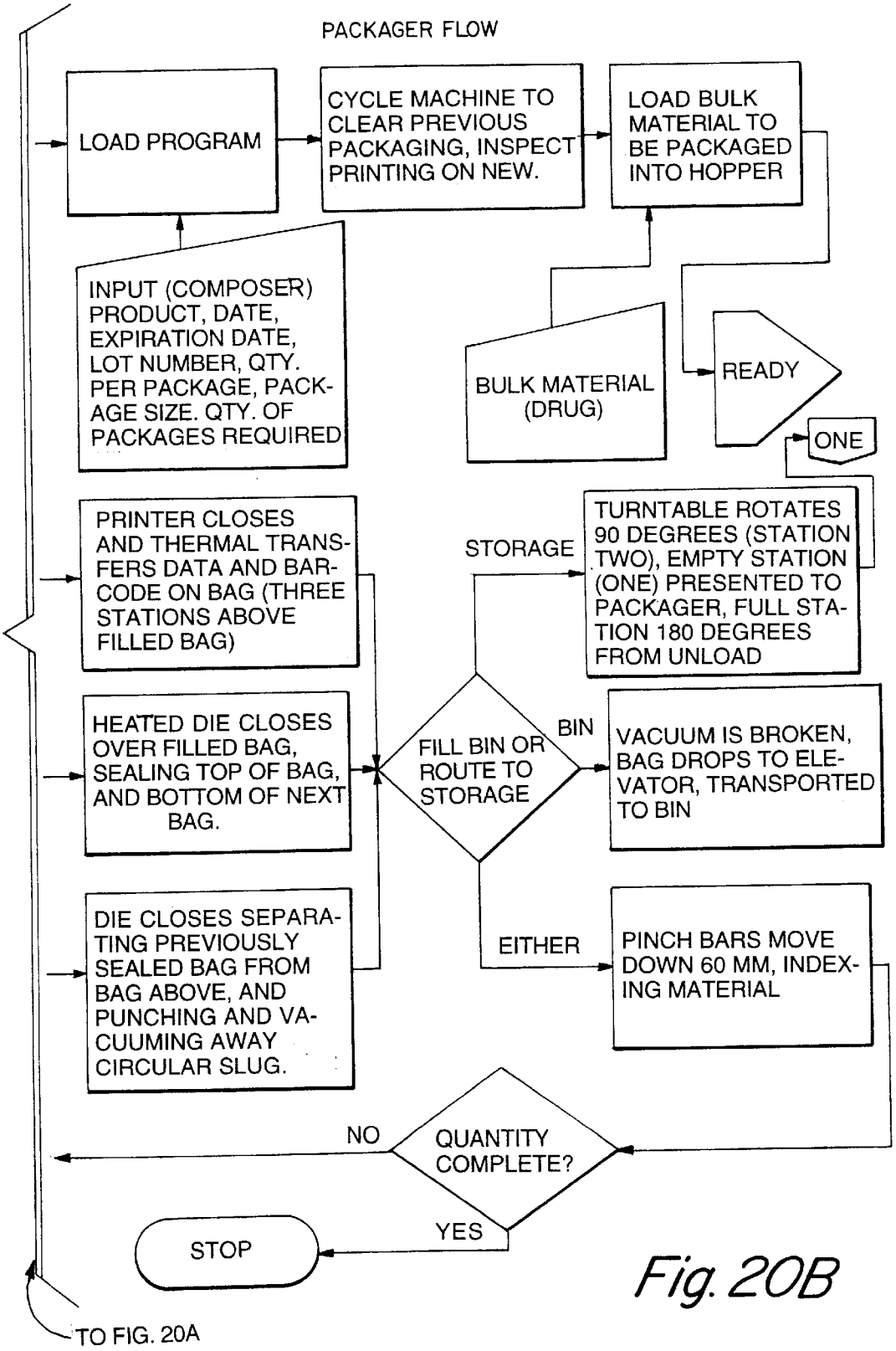
Figure 21A:
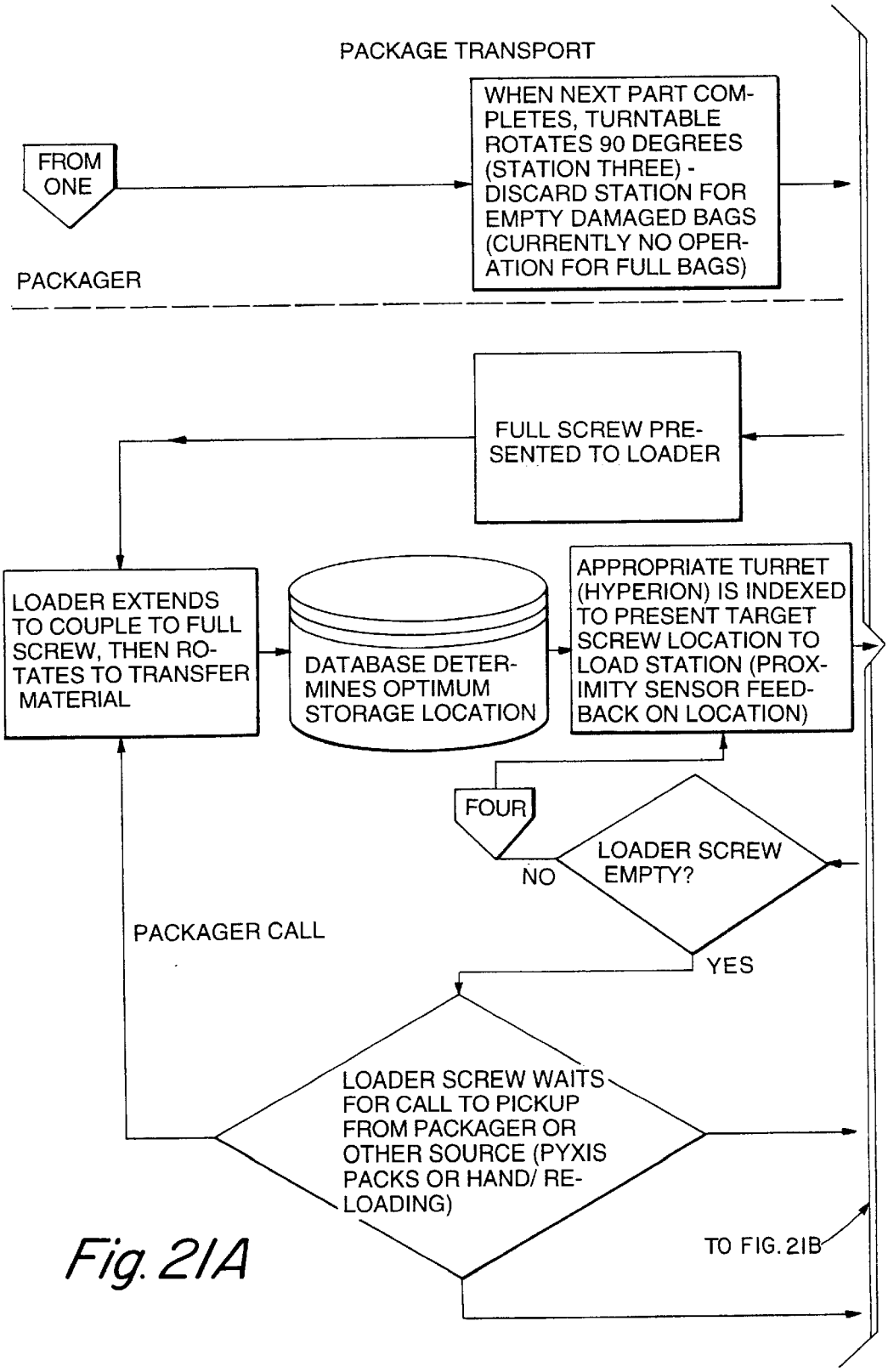
FIGS. 21A and 21B is a flow diagram of a preferred package transport process of the present invention.
Figure 21B:
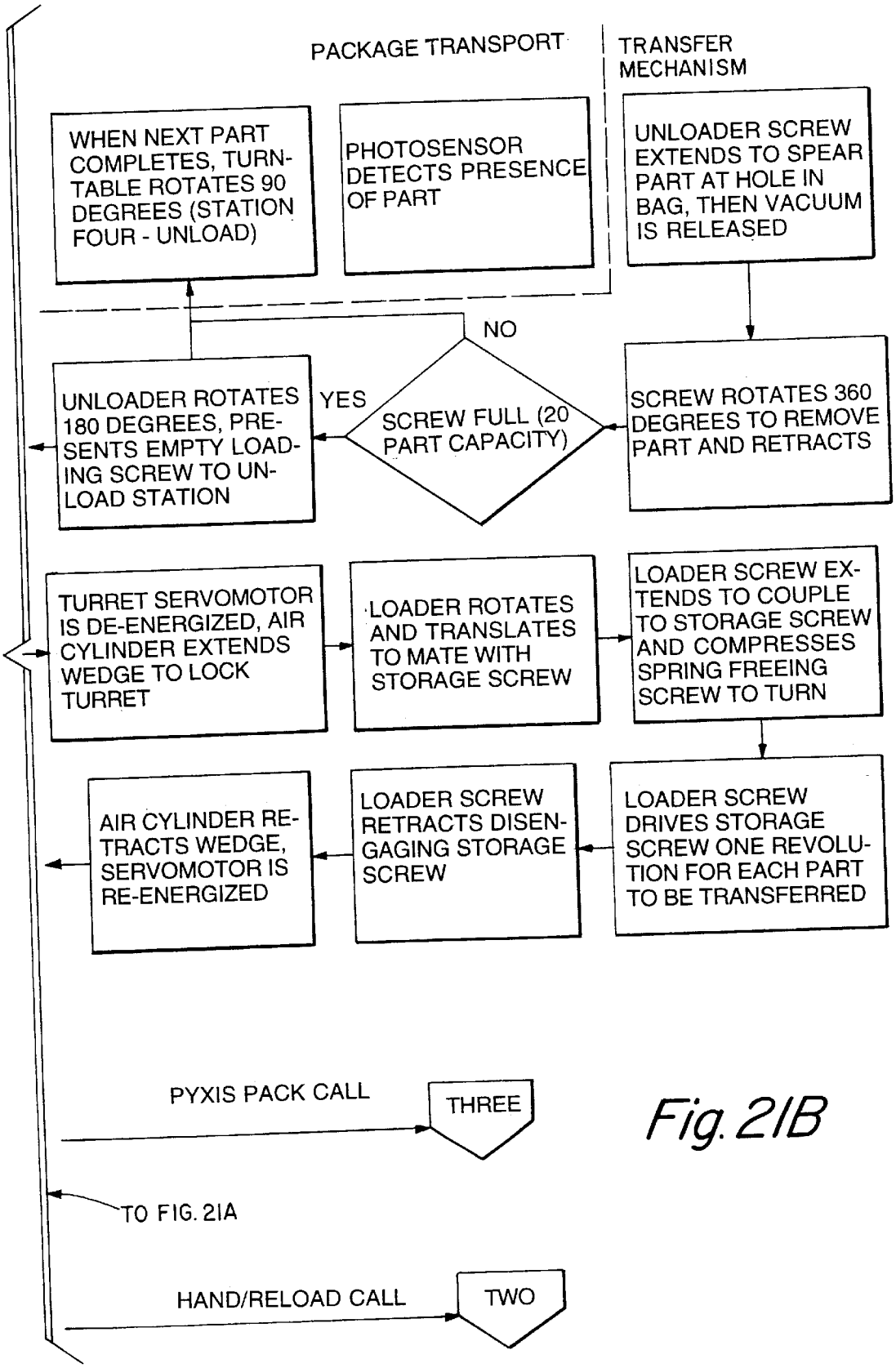
Figure 22:
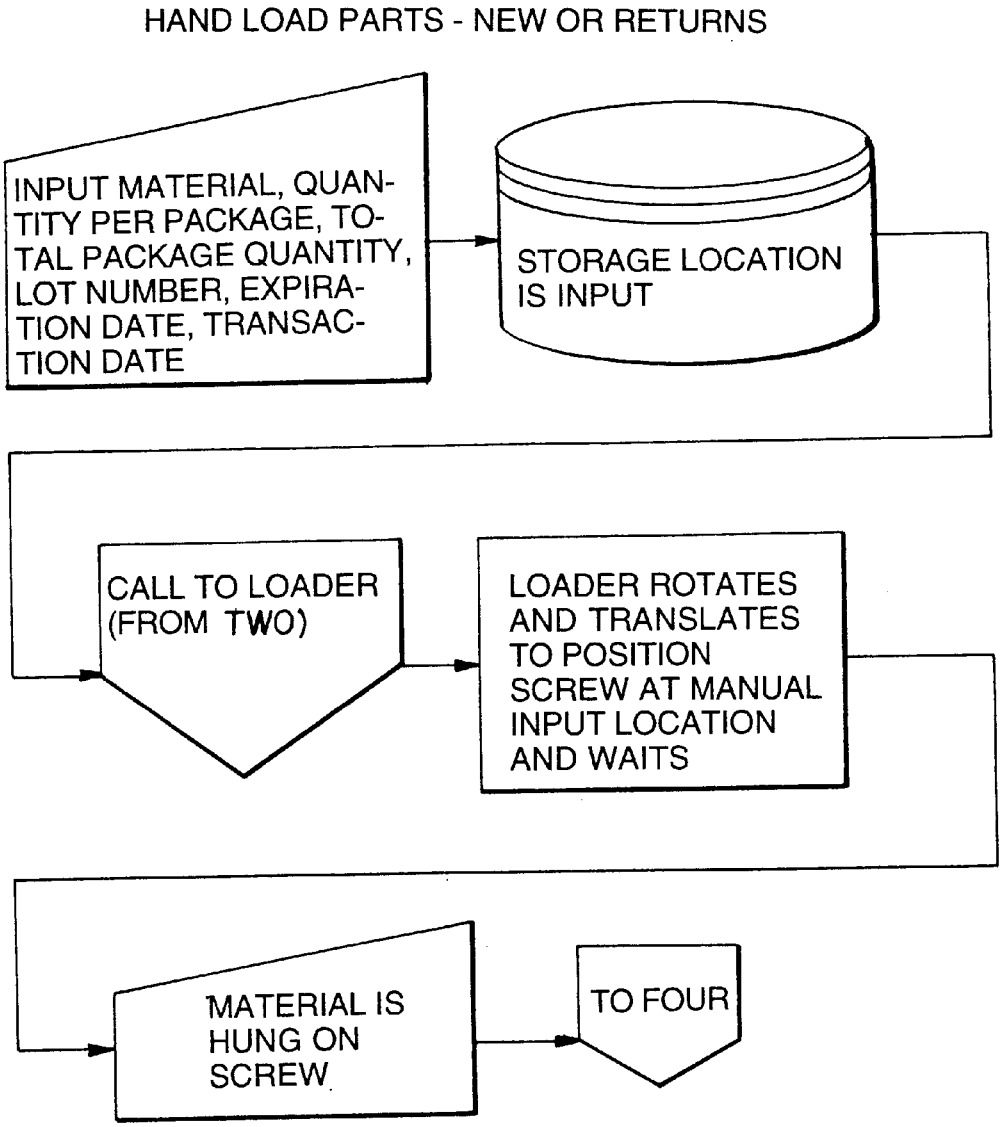
FIG. 22 is a flow diagram of a preferred process of the present invention for hand loading part for items.
Figure 23:
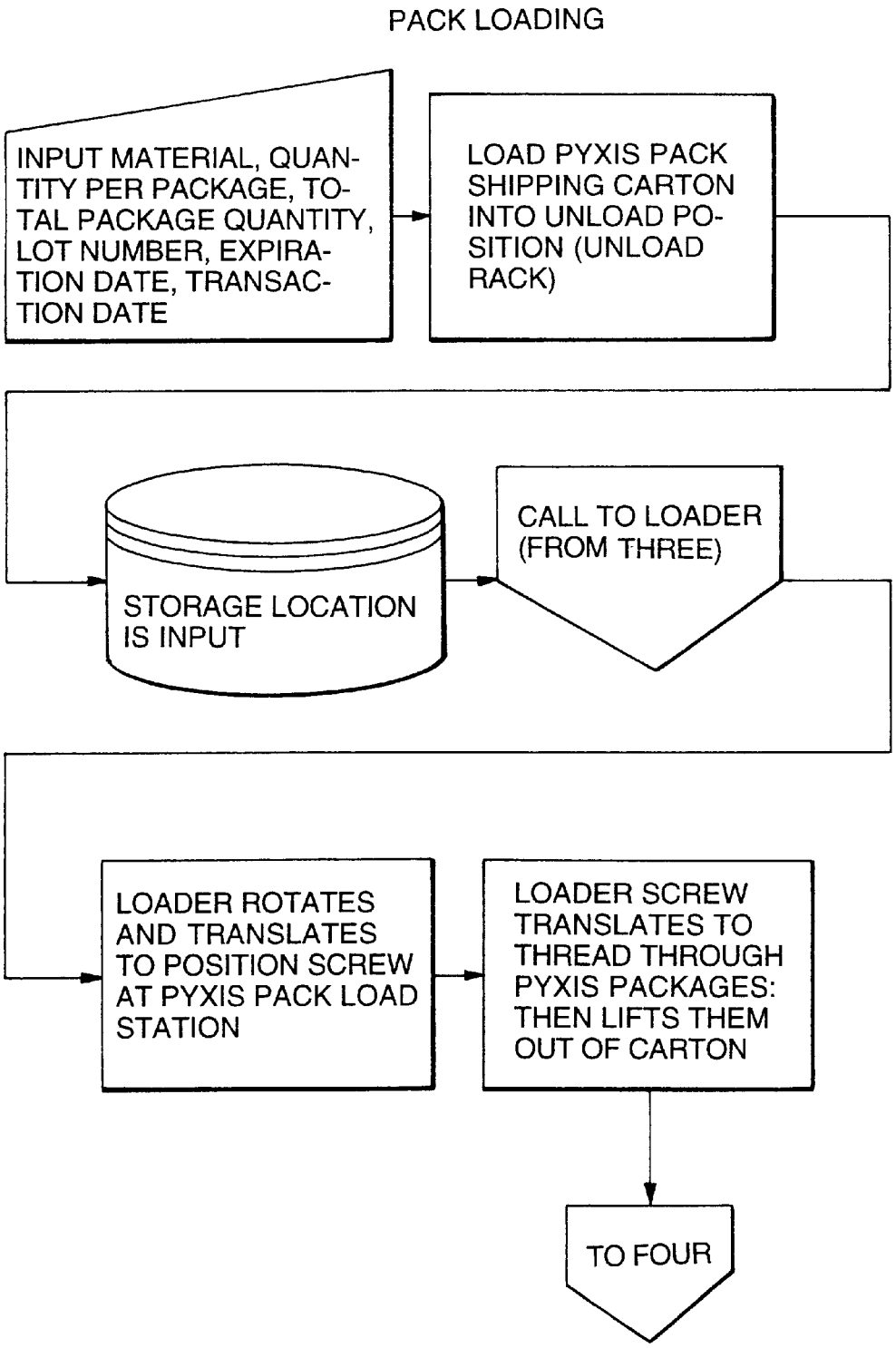
FIG. 23 is a flow diagram of a preferred pack loading process of the present invention.
Figure 24A:
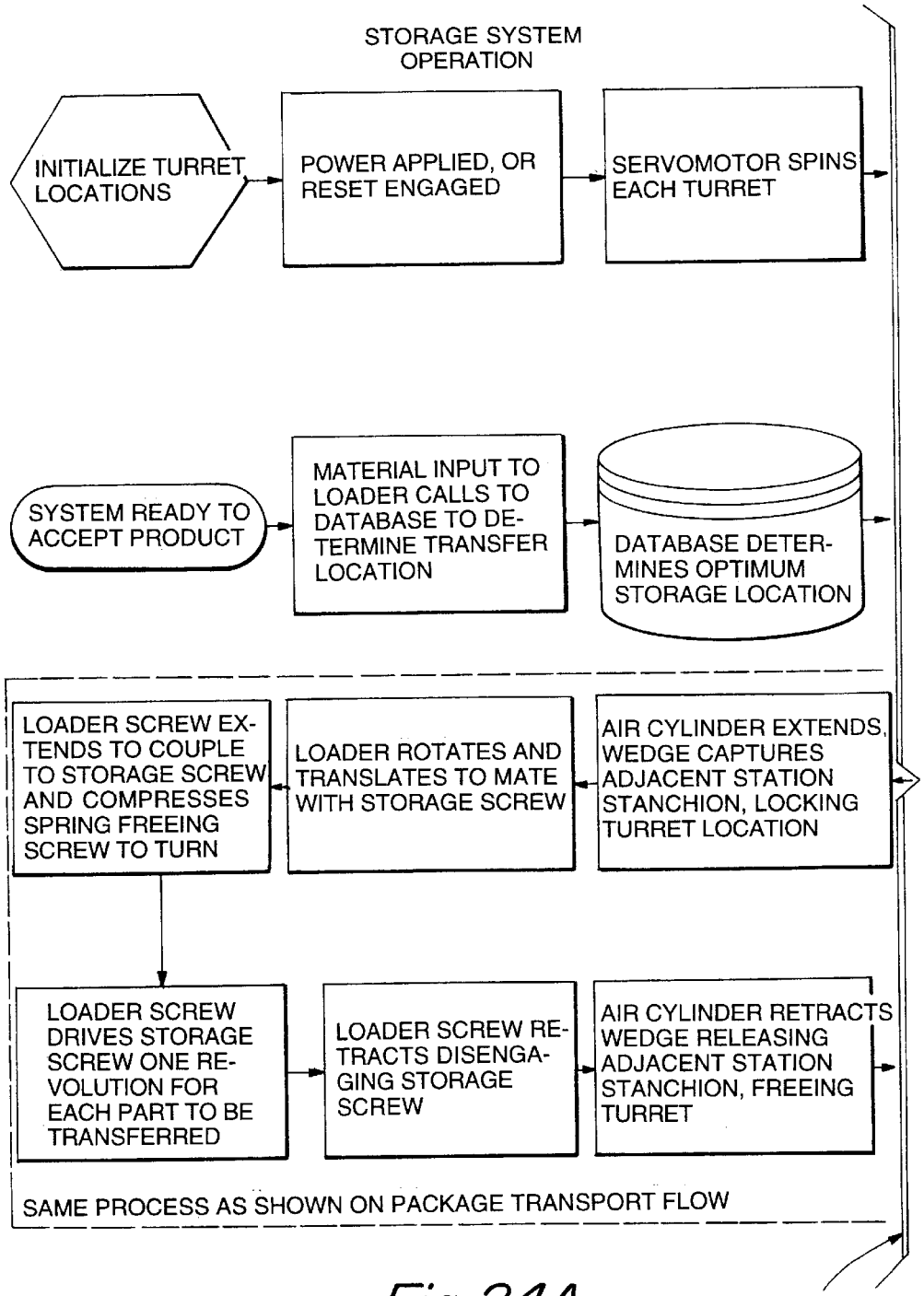
FIGS. 24A and 24B is a flow diagram of a preferred storage system process of the present invention.
Figure 24B:
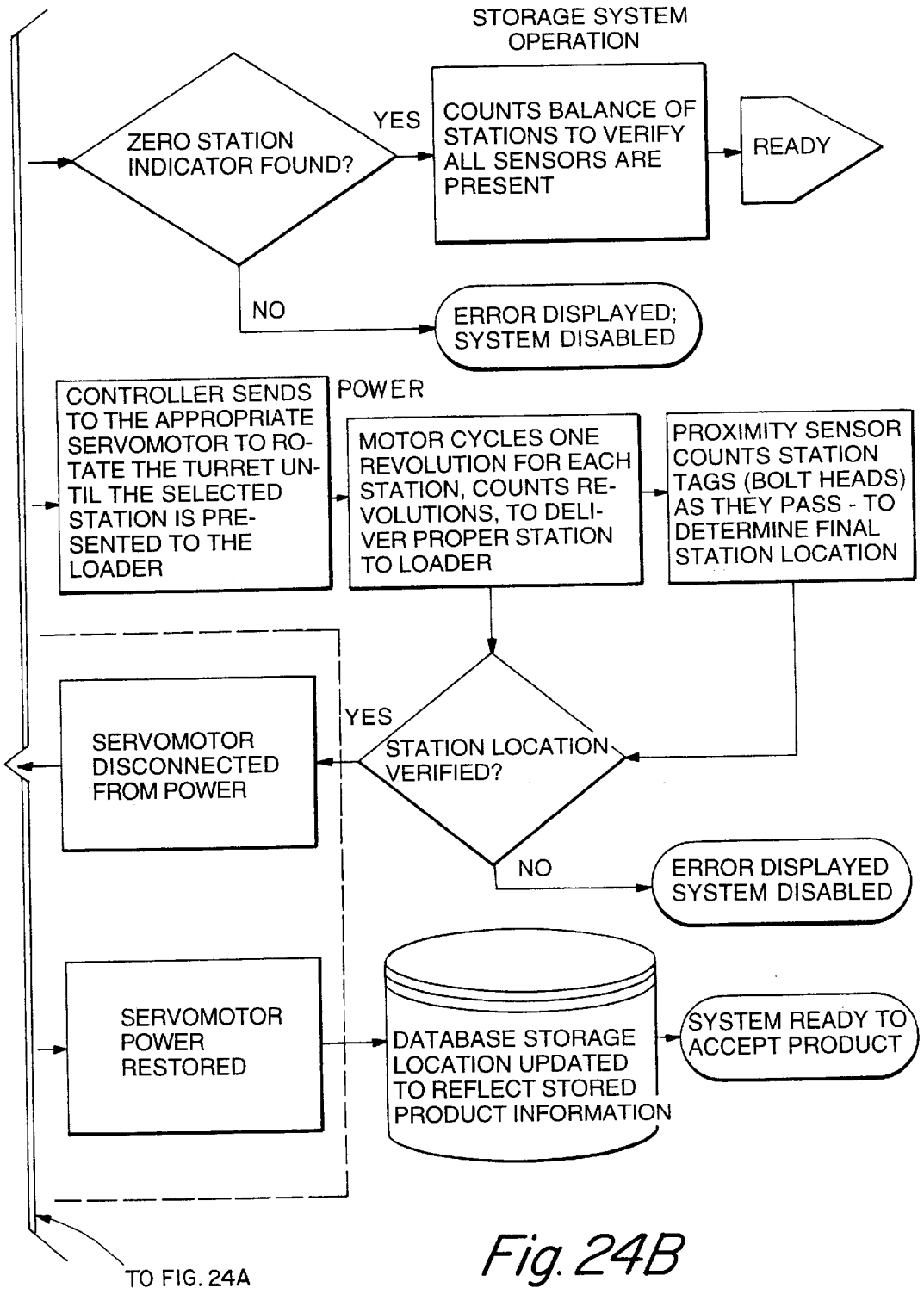
Figure 25A:
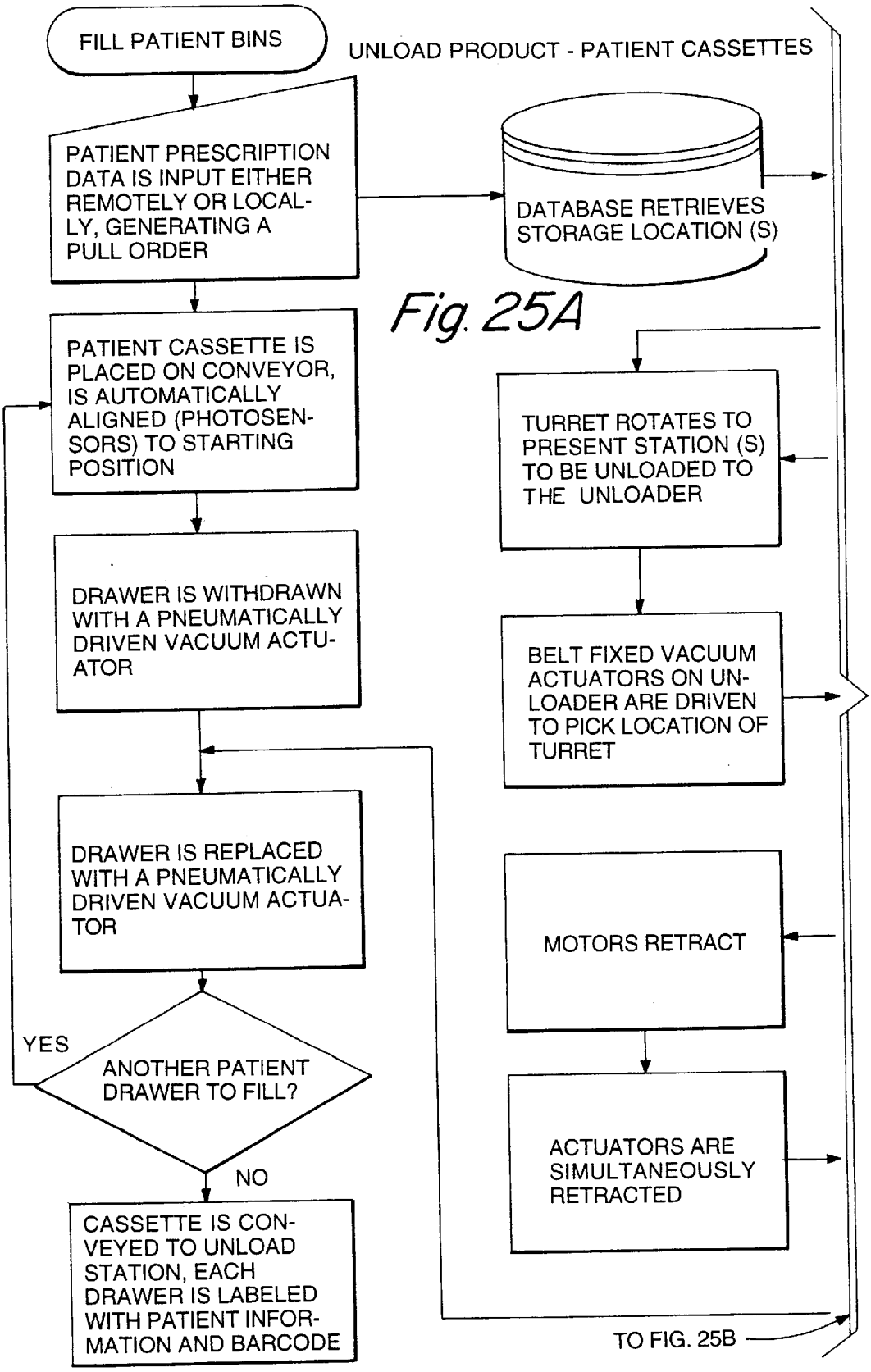
FIGS. 25A and 25B is a flow diagram of a preferred process of the present invention for unloading products in patient cassettes.
Figure 25B:
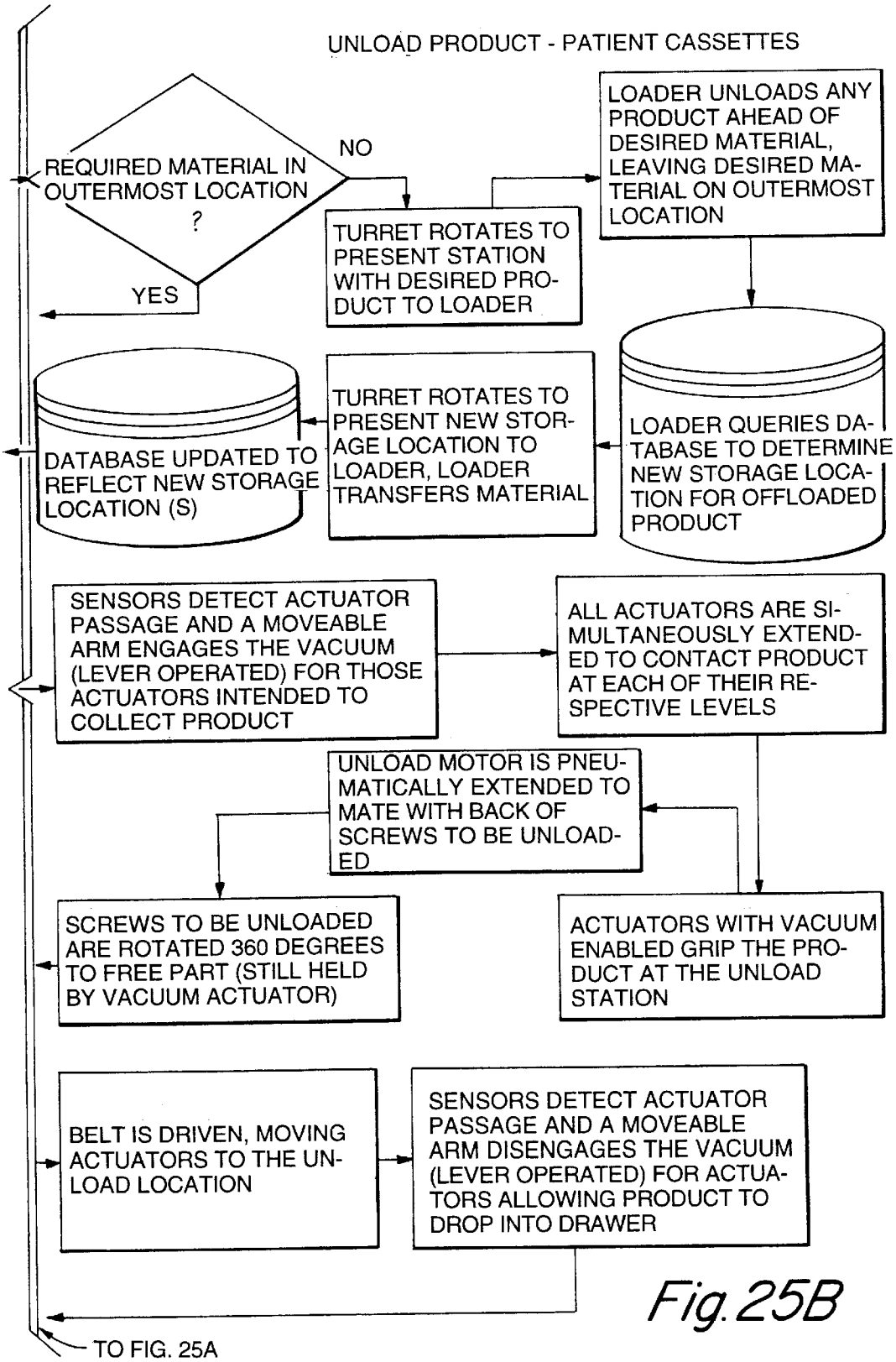
Figure 26A:
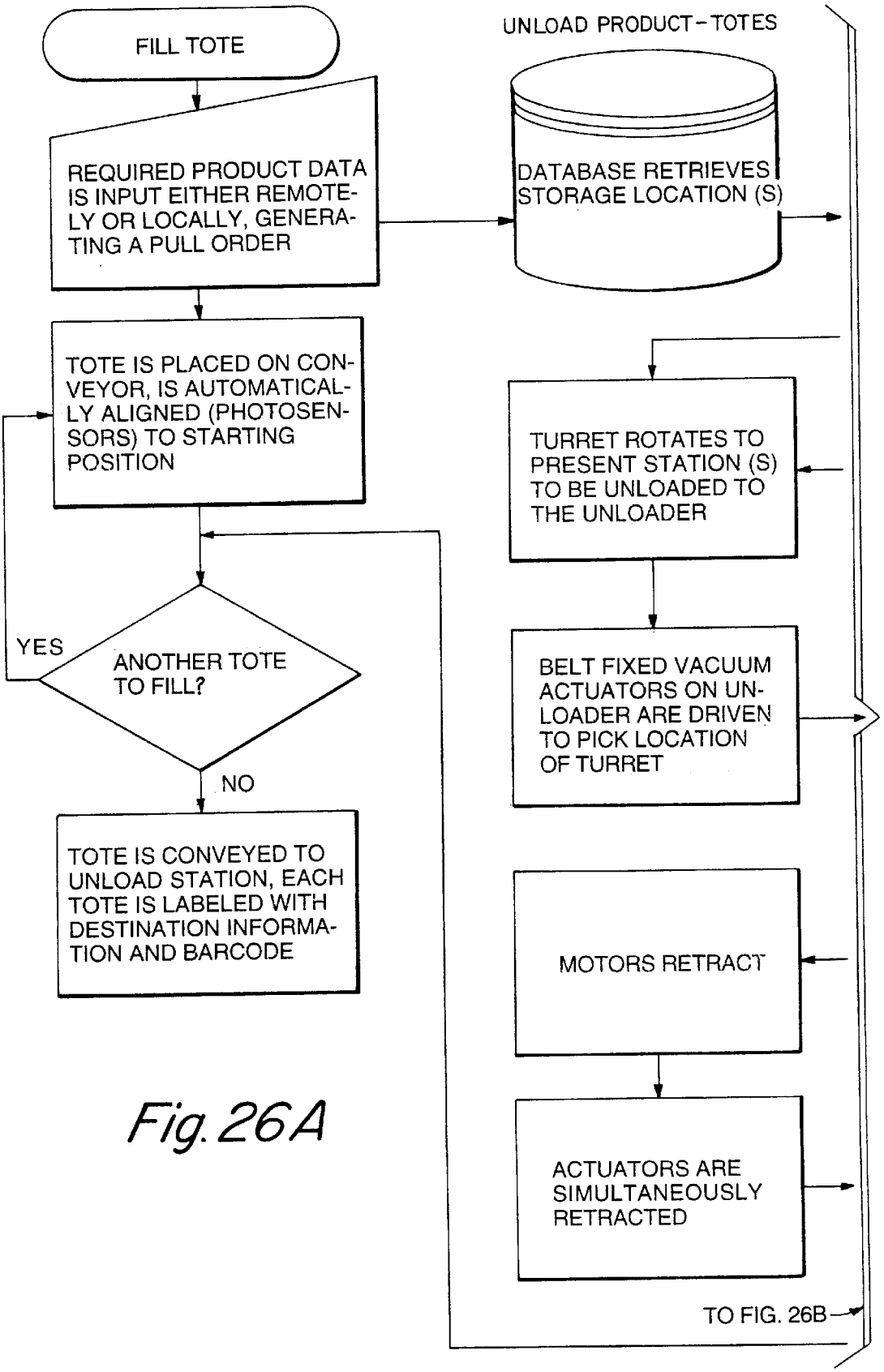
Figure 27:
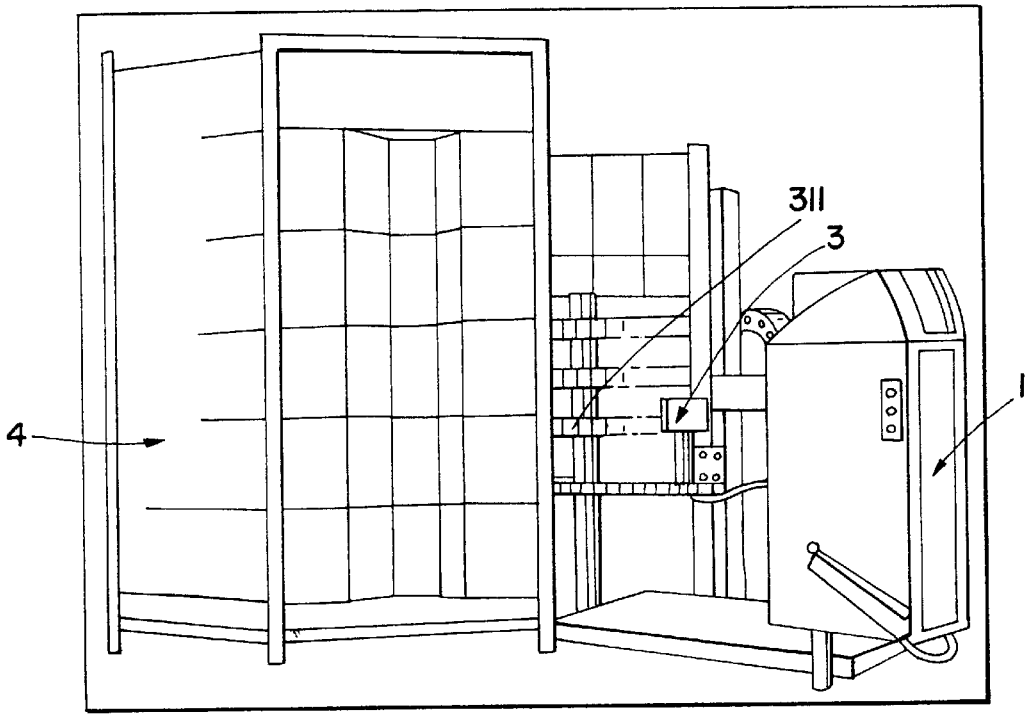
FIG. 27 is a pictorial view of a portion of the handling system of the present invention.
Figure 28:
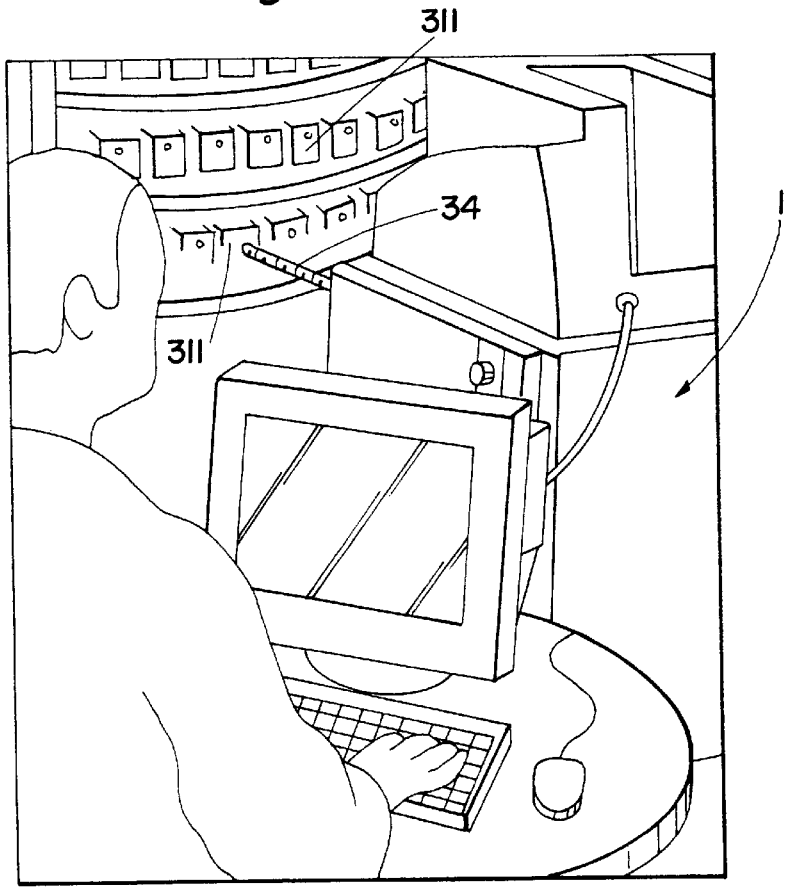
FIG. 28 is a pictorial view of a data input terminal in communication with the handling system shown in FIG. 27.
Figure 29:
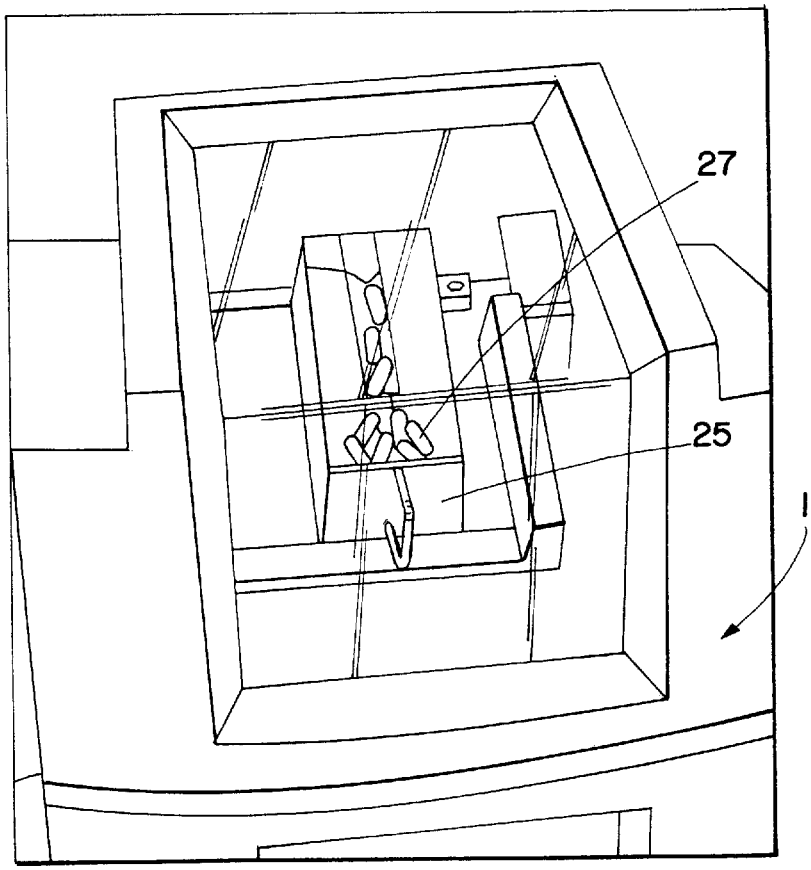
FIG. 29 is a pictorial view of a preferred portion of the feeding subsystem of the present invention.
Figure 34:
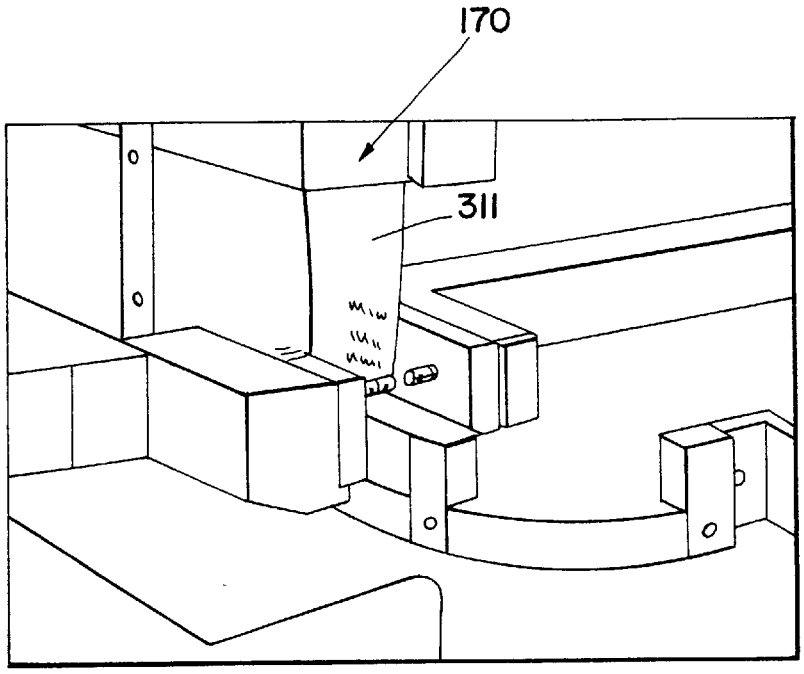
FIG. 34 is a pictorial view of another preferred portion of the handling system of the present invention.
Figure 30:
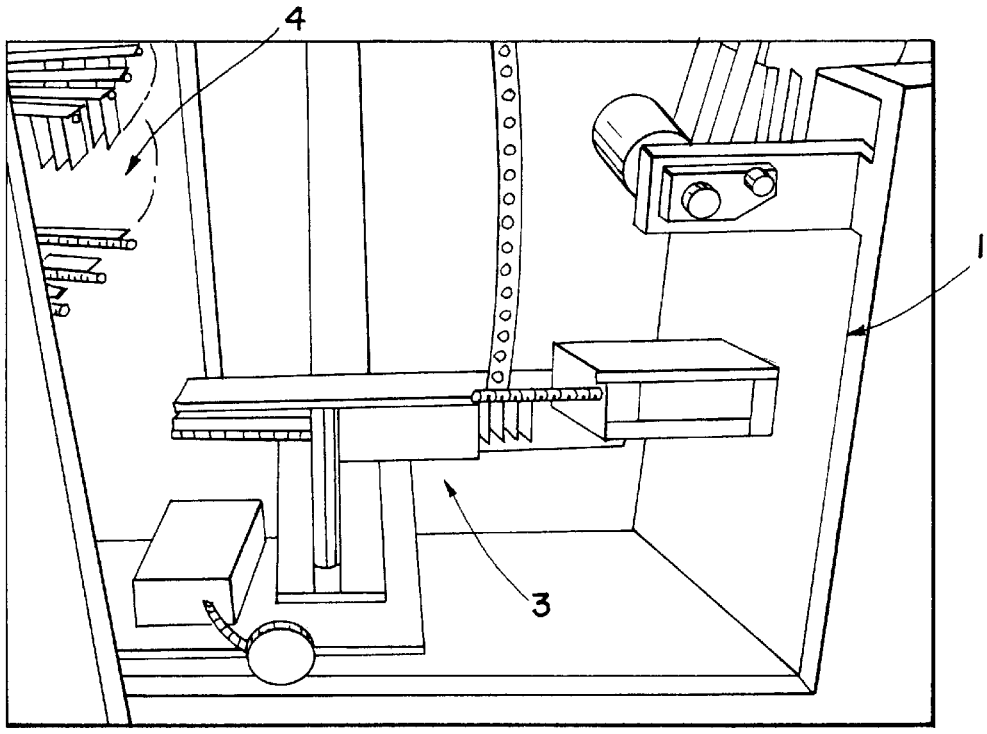
FIG. 30 is a pictorial view of a robotics portion of the preferred handling system of the present invention.
Figure 31:
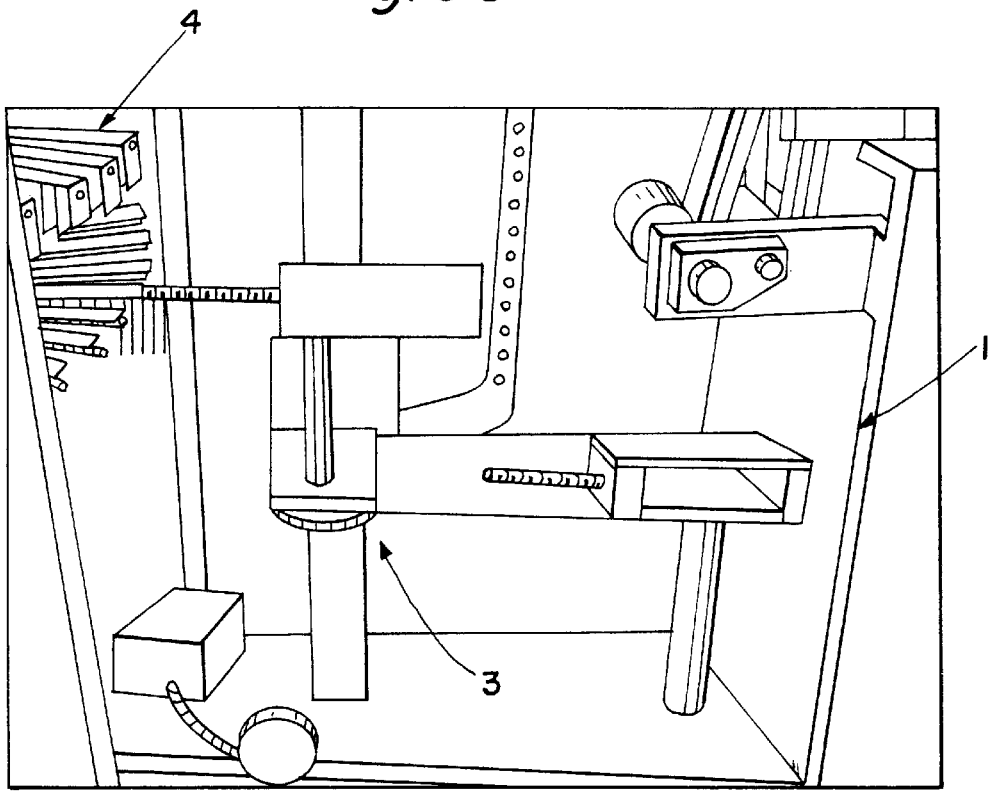
FIG. 31 is a pictorial view of another preferred portion of the handling system of the present invention.

As shown in FIGS. 12 through 15, the package or packages may be dropped into a container 57 such as a tote, a cubie, a bin, or a patient specific drawer of a ward service cart. The container 57 may situated on a conveyor 51. After the package or packages are released into the container 57, the container 57 may move on the conveyor 51 in the direction indicated by arrow C to a labeler 50. The labeler 50 may be used to label the package with any desired information. FIG. 19 shows a diagrammatical overview of a preferred embodiment of the system of the present invention. FIGS. 20–26 show preferred processes of the present invention in the form of flow diagrams. Lastly, FIGS. 27–34 show pictorial views of a preferred embodiment of the present invention to provide greater detail of the association of various parts of the equipment of the present invention.

Based on the description of preferred embodiments of the invention, it should be recognized that the present invention provides an automated and integrated packaging, loading, storing, and retrieving system. Each of the aforementioned functions may be performed simultaneously. In addition, a plurality of packagers 1, a plurality of feeder devices 3, and/or a plurality of unloading devices 5 may be used simultaneously in conjunction with a single magazine 4.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A system for transferring items comprising:

a) a packaging machine adapted to package at least one item in a package having a hole therethrough, said packaging machine adapted to transfer said package to a first position; and b) a first transfer device having a loading screw adapted to rotate in a first direction in order to receive said package when said package is in said first position and in a second direction opposite said first direction in order to transfer said package, said transfer device being adapted to retrieve said package from said packaging machine when said package is in said first position by engaging said package through the hole in said package such that said package hangs from a position between threads of the loading screw, and to transfer said package to a predetermined location by rotating the loading screw to thereby move said hanging package along an axis of the loading screw, and said transfer device further being adapted to move said loading screw such that said loading screw is abutted against and coupled with a desired storage screw, said first transfer device adapted to transfer said package from said loading screw to said desired storage screw by jointly rotating said loading screw and desired storage screw; and c) a storage device having at least one storage screw and being adapted for receiving said package from said first transfer device when said package is in a predetermined location, said storage device also having at least one level comprised of at least one said storage screw and being adapted to rotate said desired storage screw to a transfer position to enable said first transfer device to couple said loading screw with said desired storage screw;

wherein said packaging machine, said first transfer device and said storage device are adapted to operate automatically.

2. The system of claim 1 wherein said packaging machine includes a hopper adapted to distribute a predetermined quantity of said item into said package.

3. The system of claim 1 further comprising a second transfer device adapted to receive said package at said predetermined location and to transfer said package to a second position.

4. The system of claim 3 wherein said second transfer device comprises:

at least one suction hose which is connected to a vacuum device;

wherein said second transfer device is adapted to use suction to engage said package and transfer said package to said second position.

5. The system of claim 3 wherein said second transfer device further comprises:

at least one sensor adapted to sense the presence of said at least one item in said package;

wherein said second transfer device is adapted to route packages which do not contain the correct quantity of said item away from said first transfer device.

6. The system of claim 3 further comprising a third transfer device that comprises a transfer screw adapted to engage said package when said package is in said second position and to transfer said package to a third position.

7. The system of claim 1 wherein said first transfer device is adapted to rotate at least about 180 degrees between said position at which said first transfer device receives said package and said position at which said package is in said predetermined location.

8. The system of claim 1 wherein said first transfer device is adapted to rotate in a substantially horizontal plane between said position at which said first transfer device receives said package and said position at which said package is in said predetermined location.

9. The system of claim 1 wherein said first transfer device is adapted to rotate in a substantially vertical plane between said position at which aid first transfer device receives said package and said position at which said package is in said predetermined location.

10. The system of claim 1 wherein said first transfer device is further adapted to move up and down in a substantially vertical plane in order to transfer said package to said predetermined location.

11. The system of claim 1 wherein said loading screw is adapted to rotate in a first direction in order to engage said package when said package is in said first position and in a second direction opposite said first direction in order to disengage said package when said package is in said predetermined location.

12. The system of claim 1 wherein said first transfer device is adapted to move said loading screw in a substantially horizontal plane such that said loading screw is abutted against and coupled with said desired storage screw.

13. The system of claim 1 wherein:

said storage device has a plurality of levels, each of said plurality of levels comprised of at least one storage screw; and said storage device is adapted to rotate the level having said desired storage screw independently of the other levels.

14. The system of claim 1 wherein said desired storage screw is adapted to store a plurality of objects.

15. The system of claim 1 wherein said storage device is a turret-style storage device.

16. The system of claim 1 wherein said storage device is a rotatable turret mechanism.

17. The system of claim 1 wherein said storage device is a rotatable multi-turret mechanism adapted for independent turret rotation with respect to other turrets of said mechanism.

18. The system of claim 1 wherein said storage device is a rotatable turret mechanism adapted to hold a plurality of items in packages that are carried on said turret.

* * * * *